US007345685B2

(12) United States Patent
Miyazawa

(10) Patent No.: US 7,345,685 B2
(45) Date of Patent: Mar. 18, 2008

(54) ELECTRONIC CIRCUIT, OPTOELECTRONIC DEVICE, METHOD FOR DRIVING OPTOELECTRONIC DEVICE, AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 482 days.

(21) Appl. No.: 10/444,420

(22) Filed: May 27, 2003

(65) Prior Publication Data

US 2004/0090434 A1 May 13, 2004

(30) Foreign Application Priority Data

May 31, 2002 (JP) ..... 2002-159925
May 22, 2003 (JP) ..... 2003-145438

(51) Int. Cl.
*G09G 5/00* (2006.01)

(52) U.S. Cl. ..... 345/207; 345/204; 345/210

(58) Field of Classification Search ..... 345/87–100, 345/204–215

See application file for complete search history.

(56) References Cited

U.S. PATENT DOCUMENTS 5,994,876 A * 11/1999 Canny et al. ..... 320/132
6,035,237 A * 3/2000 Schulman et al. ..... 607/63
6,157,245 A * 12/2000 Rincon-Mora ..... 327/539
6,369,786 B1 4/2002 Suzuki ..... 345/77
6,470,803 B1 * 10/2002 Liu et al. ..... 102/206
6,522,395 B1 * 2/2003 Bamji et al. ..... 356/5.01
6,829,598 B2 * 12/2004 Milev ..... 706/26
2004/0207615 A1 * 10/2004 Yumoto ..... 345/211

FOREIGN PATENT DOCUMENTS

JP A-11-272233 10/1999
JP A-2000-221942 8/2000
JP A-2003-122303 4/2003
JP A 2003-140612 5/2003
WO WO 01/006484 A1 1/2001

OTHER PUBLICATIONS

CN 1242563A corresponding to U.S. 6,369,786 (Chinese-language copy not enclosed).

* cited by examiner

*Primary Examiner*—Vijay Shankar
(74) *Attorney, Agent, or Firm*—Oliff & Berridge, PLC

(57) ABSTRACT

An electronic circuit, an electronic device, and an electronic apparatus are provided that are capable of display with good quality and reducing operation delay, and a method to drive the electronic circuit. First and second switching transistors are turned on and an operation voltage Vdx and a data-current Idata are transmitted to a holding capacitor. The conduction state of a driving transistor is set according to an electrical-charge amount corresponding to the data-current Idata held in the holding capacitor and a current that passes the driving transistor is transmitted to an organic EL element. Then, a first switch is turned off, a second switch and the second switching transistor are turned on, and a reset voltage Vr is transmitted to the holding capacitor, whereby the driving transistor is turned off and the organic EL element stops emitting light.

22 Claims, 13 Drawing Sheets

ELECTRONIC CIRCUIT, OPTOELECTRONIC DEVICE, METHOD FOR DRIVING OPTOELECTRONIC DEVICE, AND ELECTRONIC APPARATUS

BACKGROUND OF THE INVENTION

1. Field of Invention

The present invention relates to an electronic circuit, an optoelectronic device, a method to drive the optoelectronic device, and an electronic apparatus.

2. Description of Related Art

Recently, optoelectronic devices with high definition and a large screen have been in demand. The optoelectronic devices have a plurality of optoelectronic elements and are widely used as a display device. Therefore, dependency on active-matrix-drive optoelectronic devices having pixel circuits to drive each of the plurality of optoelectronic elements has been becoming greater than that on passive-drive optoelectronic devices. However, the plurality of optoelectronic elements need to be controlled with precision to obtain increased high definition and a larger screen. Accordingly, it becomes necessary to compensate for characteristic variations in active elements forming the plurality of pixel circuits.

As a method to compensate for the characteristic variations in the active elements, a display device having a pixel circuit including a transistor subjected to diode connection has been proposed in Japanese Unexamined Patent Application Publication No. 11-272233.

SUMMARY OF THE INVENTION

For low gray-scale display, data is often inadequately written because of capacitance of wiring such as a data line or the like. It is particularly difficult to compensate for the characteristic variations in the active elements and increase the speed of writing low gray-scale data. In particular, according to a driving method to transmit a data-current or a current signal as a data signal to compensate for the characteristic variations of the active elements, inadequate data writing tends to be significant.

Further, since the range of uses for so-called hold optoelectronic devices, such as a liquid-crystal display device, an organic EL device, and so forth, has been increasing, further improvement of the quality of animation display has been demanded.

The present invention addresses the above-described problems.

An electronic circuit of the present invention includes a first transistor and a holding element connected to a gate of the first transistor. The holding element has a function of accumulating an electrical-charge amount corresponding to a first signal transmitted as a current and a function of accumulating an electrical-charge amount corresponding to a second signal transmitted as a voltage.

Therefore, the operation of the first transistor can be controlled by the electrical-charge amount corresponding to the first signal being transmitted as a current, and the electrical-charge amount corresponding to the second signal being transmitted as a voltage, both of which are accumulated in the holding element.

If a current signal is used as the first signal to drive an electronic element by using the above-described electronic circuit, the accuracy of driving the electronic element increases. Further, if a voltage signal is used as the second signal, the speed of driving the electronic element increases.

In the above-described electronic circuit, the second signal is preferably set so that conduction state of the first transistor, this conduction state being determined based on the electrical-charge amount set by the second signal, becomes lower than the conduction state of the first transistor, this conduction state being determined based on the electrical-charge amount set by the first signal.

It is preferable that, in the above-described electronic circuit, the second signal is set so that the conduction state of the first transistor becomes substantially off.

Subsequently, the first transistor can be set to a conduction state corresponding to the electrical-charge amount accumulated in the holding element according to the first signal, for example. Further, the first transistor can be set to a non-conduction state corresponding to the electrical-charge amount accumulated in the holding element according to the second signal. Accordingly, the length of a time period, where the conduction state set by the first signal is kept, can be adjusted or set by transmitting the second signal.

The above-described electronic circuit may further include a second transistor so that at least one of the first and second signals is transmitted via the second transistor.

Subsequently, the second transistor can transmit the first signal and the second signal to the holding element as a current and a voltage, respectively, at a predetermined timing.

The above-described electronic circuit may further include a third transistor to control the connection between the source or the drain of the first transistor and one of electrodes of the holding element.

In the above-described electronic circuit, the third transistor can be used to compensate for the characteristic variation of the first transistor, such as a threshold voltage or the like.

The above-described electronic circuit may further include a current-driving element. In this case, the amount of current transmitted to the current-driving element can be determined according to the electrical-charge amount accumulated in the holding element.

In the above-described electronic circuit, the first transistor is preferably a P-channel transistor particularly when the first transistor is a thin-film transistor (TFT). In this case, deterioration of the P-channel transistor, with increasing time of use, is smaller than in the case of an N-channel transistor.

In the above-described electronic circuit, the current-driving element and the first transistor may be electrically connected via the drain or the source of the first transistor.

An electronic device of the present invention has the above-described electronic circuits at the intersections of a plurality of first signal lines and a plurality of second signal lines.

In the above-described electronic device, the current-driving element provided in the electronic circuit may be a current-drive optoelectronic element that develops an optical effect by being supplied with a current.

In the above-described electronic device, the luminance of the current-drive optoelectronic element is preferably controlled by the electrical-charge amount accumulated in the holding element, according to the first signal. The luminance can be modified by the electrical-charge amount accumulated in the holding element, according to the second signal.

In the above-described electronic device, the current-drive optoelectronic element may be an organic EL element.

In the above-described electronic device, the first signal line may be connected to a current-signal output circuit to output the first signal and a voltage-signal output circuit to output the second signal.

The electronic device may be an optoelectronic device. In this case, the first signal line corresponds to a data line and the second signal line corresponds to a scan line.

As a method to drive the electronic circuit of the present invention, the electronic circuit including the first transistor and the holding element connected to the gate of the first transistor, accumulates an electrical-charge amount according to the first signal transmitted as a current in the holding element and accumulates an electrical-charge amount according to the second signal transmitted as a voltage in the holding element.

According to the above-described method to drive the electronic circuit, the operation of the first transistor can be controlled by the electrical-charge amount accumulated in the holding element according to the first signal and the electrical-charge amount accumulated in the holding element according to the second signal.

According to the above-described method to drive the electronic circuit, the second signal is preferably set so that the conduction state of the first transistor, this conduction state being determined based on the electrical-charge amount set by the second signal, becomes lower than the conduction state of the first transistor, this conduction state being determined based on the electrical charge amount determined by the first signal.

Further, according to the above-described method to drive the electronic circuit, it is more preferable that the second signal is set so that the conduction state of the first transistor becomes substantially off.

Subsequently, the conduction state of the first transistor can be controlled from a time point of view.

In the above-described method to drive the electronic circuit, a second transistor may further be provided so that at least one of the first and second signals is transmitted via the second transistor.

Accordingly, it becomes possible to set the timing of transmitting the first signal and the timing of transmitting the second signal by controlling the conduction state of the second transistor.

In the above-described method to drive the electronic circuit, a third transistor may further be provided to control the connection between the drain of the first transistor and one of electrodes of the holding element.

In the above-described electronic circuit, the third transistor can be used to compensate for the characteristic of the first transistor, such as a threshold voltage or the like.

In the above-described method to drive the electronic circuit, the second signal may be transmitted as a voltage to the holding element via the third transistor and the first signal may be transmitted as a current signal to the holding element via the second transistor.

In the above-described method to drive the electronic circuit, a current-driving element may further be provided.

According to a first exemplary method to drive an optoelectronic device of the present invention, the optoelectronic device includes, a plurality of scan lines, a plurality of data lines, a plurality of pixel circuits having a switching transistor, a holding element, a driving transistor, and an optoelectronic element. The plurality of pixel circuits are provided at the intersections of the plurality of scan lines and the plurality of data lines. An operation includes: a first step to transmit a scan signal to turn the switching transistor on to each of the plurality of pixel circuits via one of the plurality of scan lines—the one corresponding to the pixel circuit—and to transmit a data signal to the holding element via one of the plurality of data lines—the one corresponding to the pixel circuit—and the switching transistor, accumulating an electrical amount corresponding to the data signal in the holding element, and to set the driving transistor to a first conduction state according to the electrical amount corresponding to the data signal, the electrical amount being accumulated in the holding element; and a second step to transmit a driving voltage or a driving current with a voltage level or a current level corresponding to the first conduction state, to the optoelectronic element, a plurality of times. After the first and second steps are performed, a third step, to set the driving transistor to a second conduction state, is performed before the first step is performed next time.

In the above-described method to drive the optoelectronic device, the first step and the second step may coincide with each other. Alternatively, the second step may be performed after the first step is finished.

According to a second exemplary method to drive an optoelectronic device of the present invention, the optoelectronic device includes a plurality of scan lines, a plurality of data lines, and a plurality of pixel circuits having a switching transistor, a holding element, a driving transistor, and an optoelectronic element. The plurality of pixel circuits are provided at the intersections of the plurality of scan lines and the plurality of data lines. An operation includes: a first step to transmit a scan signal to turn the switching transistor on to each of the plurality of pixel circuits via one of the plurality of scan lines—the one corresponding to the pixel circuit—and to transmit a data signal to the holding element via one of the plurality of data lines—the one corresponding to the pixel circuit—and the switching transistor, accumulating an electrical amount corresponding to the data signal in the holding element, and to set the driving transistor to a first conduction state according to the electrical amount corresponding to the data signal, the electrical amount being accumulated in the holding element; and a second step to transmit a driving voltage or a driving current with a voltage level or a current level corresponding to the first conduction state to the optoelectronic element, a plurality of times. After the first and second steps are performed, a third step, to set the driving transistor to a second conduction state by transmitting a voltage signal to the holding element, is performed before the first step is performed next time.

In the above-described method to drive the optoelectronic device, the first step and the second step may coincide with each other. Alternatively, the second step may be performed after the first step is finished.

According to a third exemplary method to drive an optoelectronic device of the present invention, the optoelectronic device includes a plurality of scan lines, a plurality of data lines, and a plurality of pixel circuits having a switching transistor, a holding element, a driving transistor, and an optoelectronic element, the plurality of pixel circuits being provided at the intersections of the plurality of scan lines and the plurality of data lines. An operation includes a first step to transmit a scan signal to turn the switching transistor on to each of the plurality of pixel circuits via one of the plurality of scan lines—the one corresponding to the pixel circuit—and to transmit a current signal as a data signal to the holding element via one of the plurality of data lines—the one corresponding to the pixel circuit—and the switching transistor, accumulating an electrical amount corresponding to the data signal in the holding element, and to set the driving transistor to a first conduction state according to the electrical amount corresponding to the data signal, the electrical amount being accumulated in the holding element, and a second step to transmit a driving voltage or a driving current with a voltage level or a current level corresponding to the first conduction state to the optoelectronic element a plurality of times. After the first and second steps are performed, a third step to set the driving transistor to a second conduction state is performed before the first step is performed next time.

In the above-described method to drive the optoelectronic device, the first step and the second step may coincide with each other. Alternatively, the second step may be performed after the first step is finished.

According to the above-described method for driving an optoelectronic device, in the third step, the voltage signal may be transmitted to the holding element via the driving transistor so that the driving transistor is set to the second conduction state.

According to the above-described method to drive an optoelectronic device, each of the plurality of pixel circuits may include a compensation transistor in addition to the driving transistor, the compensation transistor having a gate connected to the holding element. Further, in the third step, the voltage signal may be transmitted to the holding element via the compensation transistor. Accordingly, the driving transistor may be set to the second conduction state.

According to the above-described method to drive an optoelectronic device, each of the plurality of pixel circuits may include a reset transistor having a source and a drain, one of the source and the drain being connected to a gate of the driving transistor and the other being connected to a supply source of the voltage signal. Further, a current signal may be transmitted as the data signal to the holding element in the first step, and the voltage signal may be transmitted to the holding element via the reset transistor in the third step. Accordingly, the driving transistor may be set to the second conduction state.

According to the above-described method to drive an optoelectronic device, in the third step, the voltage signal may be transmitted via the corresponding data line and the switching transistor. Accordingly, the driving transistor may be set to the second conduction state.

According to the above-described method to drive an optoelectronic device, the second conduction state is preferably set so as to be lower than the first conduction state. It is preferable that the second conduction state is substantially equivalent to a state where the driving transistor is turned off.

According to a fourth exemplary method to drive an optoelectronic device of the present invention, the optoelectronic device includes a plurality of scan lines, a plurality of data lines, and a plurality of pixel circuits having a switching transistor, a holding element, a driving transistor, and an optoelectronic element, the plurality of pixel circuits being provided at the intersections of the plurality of scan lines and the plurality of data lines. An operation including a first step to transmit a scan signal to turn the switching transistor on to each of the plurality of pixel circuits via one of the plurality of scan lines—the one corresponding to the pixel circuit—and to transmit a data signal to the holding element via one of the plurality of data lines—the one corresponding to the pixel circuit—and the switching transistor, accumulating an electrical amount corresponding to the data signal in the holding element, and to set the driving transistor to a first conduction state according to the electrical amount corresponding to the data signal, the electrical amount being accumulated in the holding element and a second step to transmit a driving voltage or a driving current with a voltage level or a current level corresponding to the first conduction state to the optoelectronic element is repeated a plurality of times. After the first and second steps are performed, a third step to stop transmission of the driving voltage or the driving current to the optoelectronic element is performed before the first step is performed next time.

According to the above-described method to drive an optoelectronic device, each of the plurality of pixel circuits may include a period-control transistor between the driving transistor and the optoelectronic element. It is preferable that transmission of the driving voltage or the driving current to the optoelectronic element is stopped by turning on the period-control transistor in the second step and turning off the period-control transistor in the third step.

According to the above-described method to drive an optoelectronic device, in the first step, a current signal may preferably be transmitted as the data signal.

A first optoelectronic device according to the present invention is driven by the above-described method to drive an optoelectronic device.

A second optoelectronic device of the present invention includes a plurality of data lines, a plurality of scan lines, a plurality of pixel circuits, that are provided at the intersections of the plurality of scan lines and the plurality of data lines, and that has an optoelectronic element, a current-signal output circuit that is connected to the plurality of data lines and that outputs a data-current as a data signal to the plurality of pixel circuits via the plurality of data lines, a reset-signal generation circuit that is connected to the plurality of data lines and that outputs a reset-electrical signal via the plurality of data lines to set the luminance of the optoelectronic element to zero, and a switch to control electrical connection among the current-signal output circuit, the reset-signal generation circuit, and the plurality of data lines.

A third optoelectronic device of the present invention includes a plurality of data lines, a plurality of scan lines, a plurality of pixel circuits, that are provided at the intersections of the plurality of scan lines and the plurality of data lines, and that has an optoelectronic element, a current-signal output circuit that is connected to the plurality of data lines and that outputs a data-current as a data signal to the plurality of pixel circuits via the plurality of data lines, a plurality of voltage-signal transmission lines to transmit a reset-electrical signal for setting the luminance of the optoelectronic element to zero, and a reset-signal generation circuit that is connected to the plurality of voltage-signal transmission lines and that outputs the reset-electrical signal.

In the above-described optoelectronic device, the plurality of voltage-signal transmission lines preferably extend in a direction along which the plurality of scan lines extends.

An electronic apparatus of the present invention has the above-described optoelectronic device. The optoelectronic device is preferably used as a display unit of the above-described being mounted thereon.

DETAILED DESCRIPTION OF PREFERRED EMBODIMENTS

First Exemplary Embodiment

A first exemplary embodiment of the present invention will be described with reference to FIGS. 1 to 4.

Figure 1:
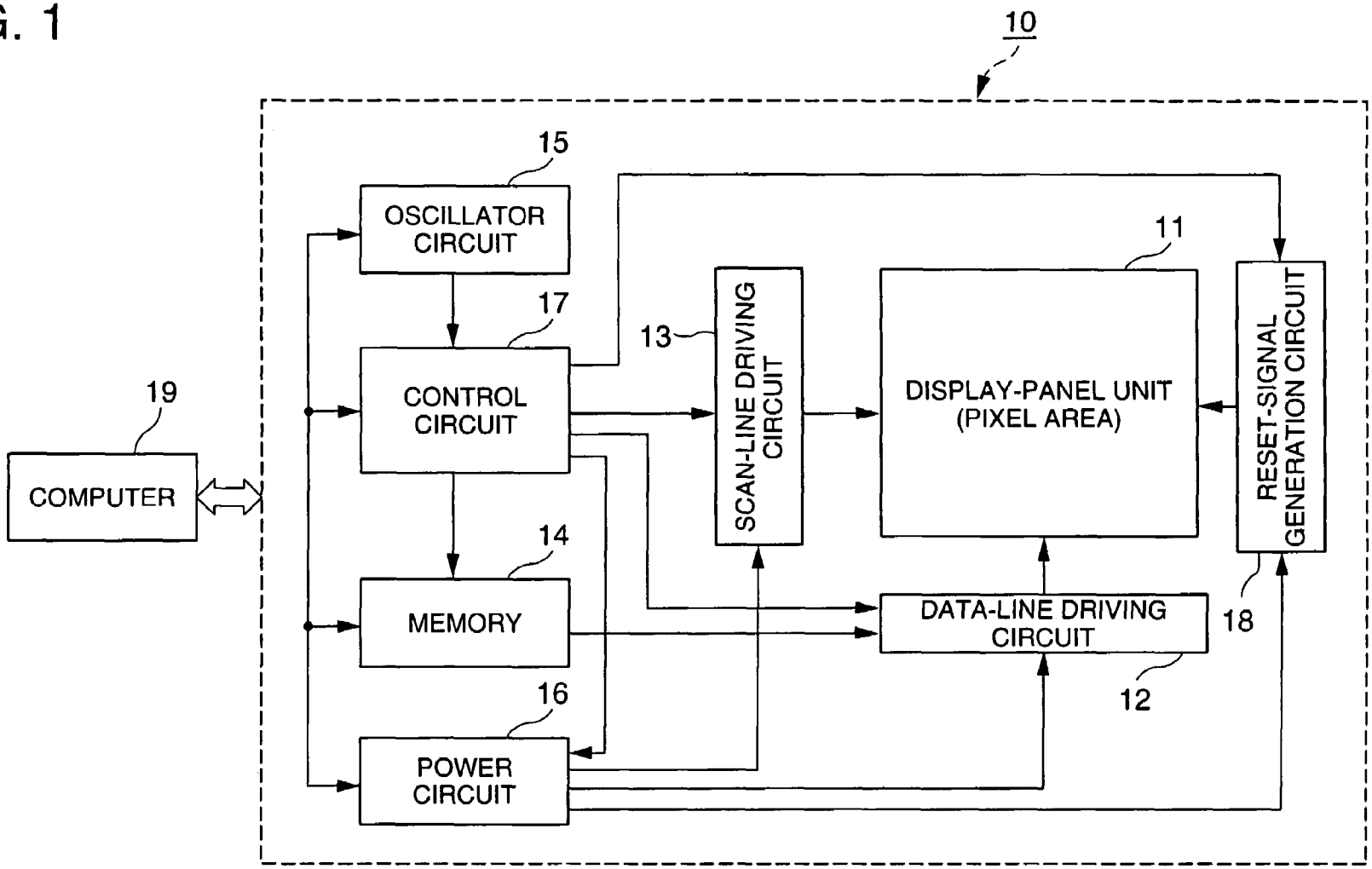
FIG. 1 is a block circuit schematic illustrating the configuration of an organic EL device according to a first exemplary embodiment.
Figure 2:
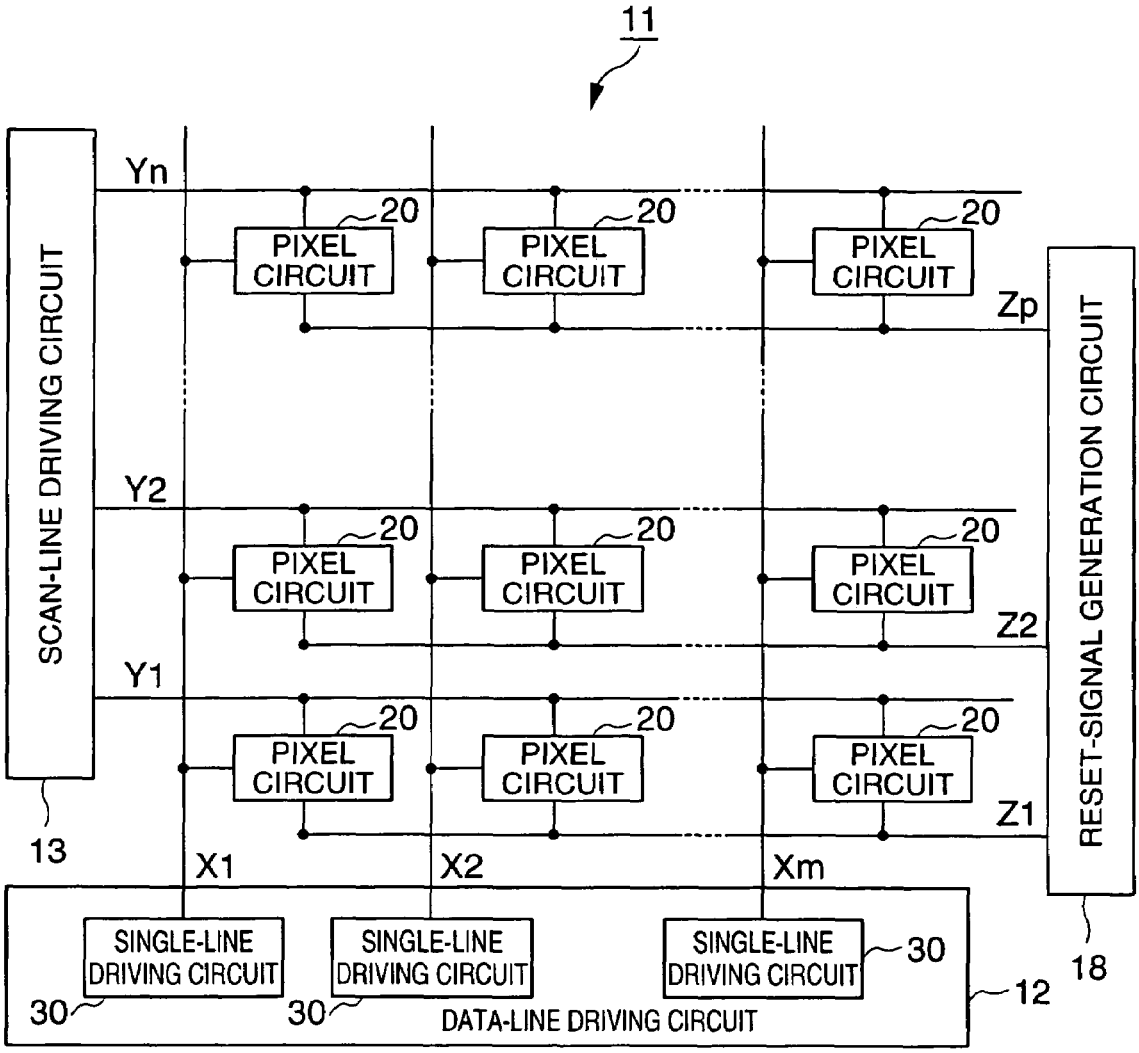
FIG. 2 is a block circuit schematic illustrating the internal configuration of a display-panel unit and a data-line driving circuit.
Figure 3:
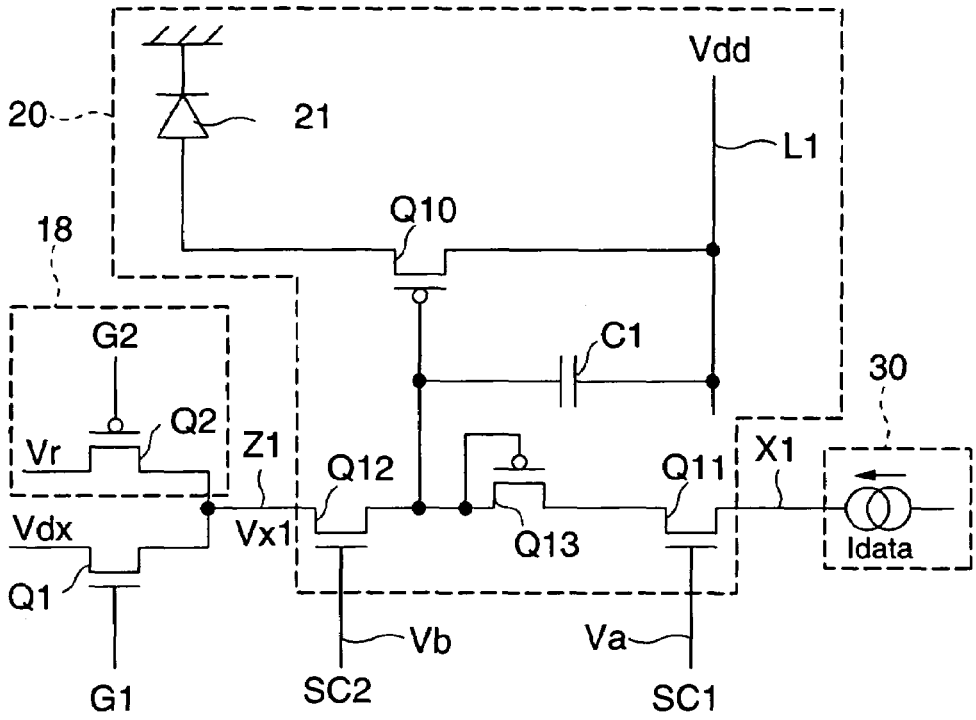
FIG. 3 is a circuit schematic illustrating the configuration of an electronic circuit including a pixel circuit.

FIG. 1 is a block diagram illustrating the circuit configuration of an organic EL device 10 functioning as an electronic device. FIG. 2 is a block diagram illustrating the internal circuit configuration of a display-panel unit and a data-line driving circuit. FIG. 3 is a circuit diagram illustrating the internal configuration of a pixel circuit and electronic circuits relating to the pixel circuit.

In FIG. 1, the organic EL device 10 functioning as the electronic device comprises a display-panel unit 11, a data-line driving circuit 12, a scan-line driving circuit 13, a memory 14, an oscillator circuit 15, a power circuit 16, a control circuit 17, and a reset-signal generation circuit 18.

The elements 11 to 18 of the organic EL device 10 may be formed as electronic parts independent of one another. For example, the elements 12 to 18 may be formed as a semiconductor integrated circuit on a chip. Further, all or part of the elements 11 to 18 may be integrated into an electronic part. For example, the data-line driving circuit 12, the scan-line driving circuit 13, and the reset-signal generation circuit 18 may be integrated into the display panel unit 11. Further, all or part of the elements 11 to 16 may be formed as a single programmable IC chip and the functions of the elements may be achieved by software, for example, a program written in the IC chip.

The display-panel unit 11 includes a plurality of pixel circuits 20 arranged in a matrix form, as shown in FIG. 2. The pixel circuits 20 function as a plurality of electronic circuits. Specifically, the pixel circuits 20 are connected between a plurality of data lines, X1 to Xm (m is an integer), that function as first signal lines and that extend in the column direction, and a plurality of scan lines, Y1 to Yn (n is an integer), that function as second signal lines and that extend in the row direction, respectively. Subsequently, the pixel circuits 20 are arranged in the matrix form. Voltage-signal transmission lines, Z1 to Zp (p is an integer), are provided so as to be parallel with the plurality of scan lines Y1 to Yn. Each pixel circuit 20 has an organic EL element 21 functioning as a driven element or an optoelectronic element. The organic EL element 21 is a light-emitting element that emits light when a driving current is supplied thereto. In general, a transistor that is included in the pixel circuit 20 and that will be described later is formed by a thin-film transistor (TFT).

The scan-line driving circuit 13 selects and drives one of the plurality of scan lines, Y1 to Yn, so as to select pixel circuits corresponding to one row. Each of the scan lines, Y1 to Yn, include a first scan line Va and a second scan line Vb, respectively, as shown in FIG. 3. The scan-line driving circuit 13 transmits a first scan-signal SC1 to the pixel circuit 20 via the first scan line Va. Further, the scan-line driving circuit 13 transmits a second scan-signal SC2 to the pixel circuit 20 via the second scan line Vb.

The second scan-signal SC2 controls the conduction between the voltage-signal transmission lines, Z1 to Zp (p is an integer), that will be described later and the pixel circuits 20.

The data-line driving circuit 12 includes single-line driving circuits 30 corresponding to the data lines X1 to Xm.

The single-line driving circuits 30 transmit data signals to the pixel circuits 20 via each of the data lines X1 to Xm. The internal state of each pixel circuit 20 (the electrical-charge amount of a holding capacitor C1 functioning as a holding element) is set according to the data signal, whereby the value of a current flowing through the organic EL element 21 is controlled and the gray scale of light emitted from the organic EL element 21 is controlled.

Each of the single-line driving circuits 30 include a current-signal output circuit so that current-signals, Idata, are output as data signals via the data lines X1 to Xm, as shown in FIG. 3.

The reset-signal generation circuit 18 supplies a reset voltage Vr to the pixel circuit 20 via a second switch Q2 and a corresponding voltage-signal transmission line of the voltage-signal transmission lines Z1 to Zp.

For at least part of a period of time where the data-line driving circuit 12 transmits the data signal, Idata, to the pixel circuit 20, an operating voltage Vdx is transmitted to the pixel circuit 20 to which the data signal, Idata, is being transmitted via the voltage-signal transmission line corresponding thereto and a first switch Q1.

According to this exemplary embodiment, a P-channel transistor is used as a driving transistor Q10, as will be described later. Therefore, the value of a reset voltage Vr is equal to or higher than that of the operating voltage Vdx. This reset voltage Vr sets the internal state of the pixel circuit 20 (the electrical-charge amount of the holding capacitor C1) to a predetermined state (the reset electrical-charge amount). That is to say, the reset voltage Vr can substantially turn the driving transistor Q10 off. The driving transistor Q1 will be described later. Therefore, the value of reset voltage Vr should be equivalent to a value obtained by subtracting a threshold voltage Vth of the driving transistor Q10, from a driving voltage Vdd transmitted from a power line L1 (=Vdd−Vth), or more. However, in this embodiment, the value of reset voltage Vr is set to be equivalent to the value of driving voltage Vdd or more.

The first switch Q1 is formed by an N-channel transistor. The conduction of the first switch Q1 is controlled by a gate-signal G1. The second switch Q2 is formed by a P-channel transistor. The conduction of the second switch Q2 is controlled by a gate-signal G2. Therefore, either the operating voltage Vdx or the reset voltage Vr can be transmitted to the voltage-signal transmission lines Z1 to Zp by controlling the conduction of the first and second switches Q1 and Q2, respectively.

The memory 14 stores display data transmitted from a computer 19. The oscillator circuit 15 transmits a reference operating signal or a control signal to the other elements of the organic EL device 10. The power circuit 16 transmits driving power to the elements constituting the organic EL device 10.

The elements 11 to 16, and 18 are subject to centralized control by the control circuit 17. The control circuit 17 changes the display data (image data) indicating the display state of the display-panel unit 11, the display data being stored in the memory 14, into matrix data indicating the gray scale of light emitted from each organic EL element 21. The matrix data includes a scan-line drive-control signal to determine the first and second scan-signals SC1 and SC2 to select pixel circuits corresponding to one row in sequence. The matrix data further includes a data-line drive-control signal to determine the level of the data-current, Idata, to determine the luminance of the organic EL elements 21 of the selected pixel circuits. The scan-line drive-control signal is transmitted to the scan-line drive-control circuit 13. The data-line drive-control signal is transmitted to the data-line driving circuit 12.

The control circuit 17 controls the drive timing of the scan lines, Y1 to Yn, the data lines, X1 to Xm, and the voltage-signal transmission lines, Z1 to Zp. Further, the control circuit 17 outputs gate signals G1 and G2 to perform ON/OFF control over the first and second switches Q1 and Q2.

The internal configuration of the pixel circuit 20 will now be described with reference to FIG. 3. For convenience, the pixel circuit 20, provided at the intersection of the first data line X1 and the first scan line Y1, will be described.

The pixel circuit 20 is connected to the first and second scan lines, Va and Vb, of the scan line Y1, the data line X1, and the voltage-signal transmission line Z1. The pixel circuit 20 has the driving transistor Q10 functioning as a first transistor, first and second switching transistors Q11 and Q12 functioning as a second transistor, the holding capacitor C1 as a holding element, and a compensation transistor Q13. Each of the driving transistor Q10 and the compensation transistor Q13 is formed as a P-channel transistor. Each of the first and second switching transistors Q11 and Q12 is formed as an N-channel transistor.

The drain of the driving transistor Q10 is connected to a pixel electrode of the organic EL element 21, and the source thereof is connected to the power line L1. The driving voltage Vdd to drive the organic EL element 21 is transmitted to the power line L1. The value of driving voltage Vdd is set to be higher than that of the operating voltage Vdx. The holding capacitor C1 is connected between the gate of the driving transistor Q10 and the power line L1.

The gate of the driving transistor Q10 is connected to the source of the first switching transistor Q1 via the compensation transistor Q13. The gate of the driving transistor Q10 is connected to the drain of the second switching transistor Q12.

The first scan line Va is connected to the gate of the first switching transistor Q11. The second scan line Vb is connected to the gate of the second switching transistor Q12.

The source of the second switching transistor Q12 is connected to the reset-signal generation circuit 18, the first switch Q1, and the second switch Q2 via the voltage-signal transmission line Z1. Therefore, when the first and second switches Q1 and Q2 are subject to ON/OFF control, either the operating voltage Vdx or the reset voltage Vr, is transmitted to the second switching transistor Q12 via the voltage-signal transmission line Z1.

The drain of the first switching transistor Q11 is connected to the single-line driving circuit 30 via the data line X1. Therefore, the data-current, Idata, from the single-line driving circuit 30 is transmitted to the pixel circuit 20 via the first switching transistor Q11. That is to say, the data-current, Idata, is transmitted via the transistors Q11, Q13, Q12, and the first switch Q1.

The action of the above-described organic EL device 10 will now be described by illustrating the operation of the pixel circuit 20.

Figure 4:
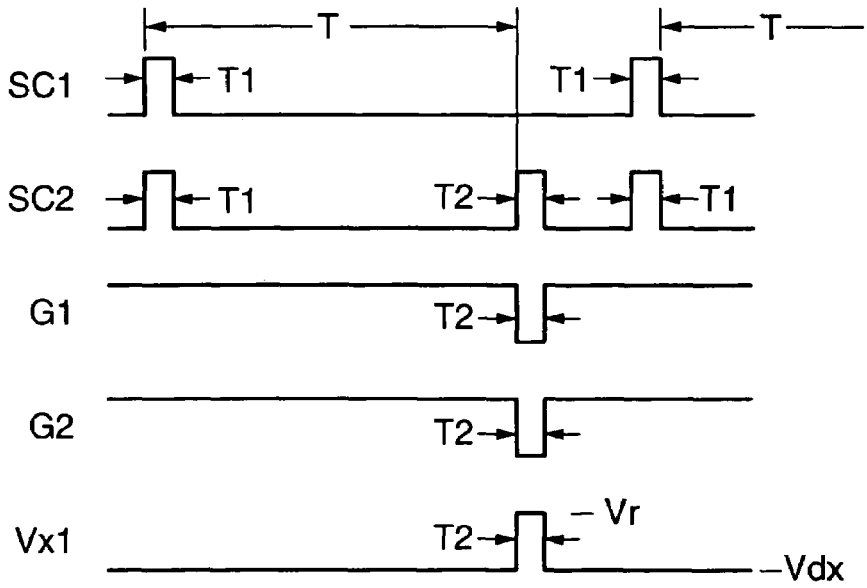
FIG. 4 shows time charts illustrating the operation of the electronic circuit.

FIG. 4 shows timing charts illustrating the operation of the pixel circuit 20. The first scan-signal SC1 is transmitted from the scan-line driving circuit 13 to the gate of the first switching transistor Q11 via the first scan line Va. The second scan-signal SC2 is transmitted from the scan-line driving circuit 13 to the gate of the second switching transistor Q12 via the second scan line Vb. A first gate-signal G1 is transmitted from the control circuit 17 to the gate of the first switch Q1. A second gate-signal G2 is transmitted from the control circuit 17 to the gate of the second switch Q2. A voltage Vx1 is the potential of the voltage-signal transmission lines, Z1 to Zp.

For the sake of simplicity, the timing charts showing the operation of the pixel circuit 20 provided for the data line X1, the scan line Y1, and the voltage-signal transmission line Z1 will be illustrated.

When the first switch Q1 is turned on and both the first and second switching transistors Q11 and Q12 are turned on within a time-period T1, the data-current, Idata, is transmitted from the single-line driving circuit 30 via the data line X1, while the voltage-signal transmission line Z1 is connected to the operating voltage Vdx. Subsequently, the data-current, Idata, passes through the first and second switching transistors Q11 and Q12 and the compensation transistor Q13 that are provided in the pixel circuit 20. Further, an electrical-charge amount corresponding to the data-current, Idata, is accumulated in the holding capacitor C1.

The conduction state of the driving transistor Q10 is determined, based on the electrical-charge amount accumulated in the holding capacitor C1 and a current with a level corresponding to the conduction state is transmitted to the organic EL element 21, whereby the organic EL element 21 emits light with luminance corresponding to the current level.

When a time-period T has elapsed after the first and second scan-signals are transmitted to turn the first and second switching transistors Q11 and Q12 on, another second scan-signal to turn the second switching transistor Q12 on, is transmitted again, whereby only the second switching transistor Q12 is turned on. Further, the first switch Q1 is turned off and the second switch Q2 is turned on, respectively, whereby the reset voltage Vr is transmitted via the second switch Q2 and the second switching transistor Q12. Consequently, the driving transistor Q10 is turned off.

When a time-period T2 has elapsed, the second scan-signal SC2 used to turn the second switching transistor Q12 off is transmitted and an electrical-charge amount corresponding to the reset voltage Vr is accumulated in the holding capacitor C1. In this state, the pixel circuit 20 enters and stays in a standby state until the data-current Idata is transmitted thereto.

The electronic circuit shown in FIG. 3 does not include a time-period-control transistor used to control time-periods between the organic EL element 21 and the driving transistor 10. Therefore, a current may be transmitted to the organic EL element 21 before the electrical-charge amount corresponding to the data-current Idata is accumulated in the holding capacitor C1, as in the case of electronic circuits shown in FIGS. 5, 9, 10, and 12.

The features and advantages of the above-described organic EL device 10 will be described below.

(1) In this exemplary embodiment, a reset operation is performed before the data signal is transmitted to the pixel circuit, for example, before one vertical-scan period or one frame ends. Therefore, the level of the data signal used to write can be set so as to be higher than in the case where an entire vertical scan period or an entire frame period is used, which is particularly effective in the case where the data-current, Idata, is transmitted as a data signal. Specifically, since the level of data-current, Idata, corresponding to the luminance at low gray scale is low, the data signal tends to be written inadequately due to parasitic capacitance or the like. However, the level of the data-current, Idata, can be set so as to be relatively high by reducing the light-emission period. Subsequently, it becomes possible to write the data signal adequately.

Further, the electrical-charge amount corresponding to the reset signal are stored in the holding capacitor C1 and the driving transistor Q10 is turned off before the next data signal is written, which corresponds to a state where the pixel circuit is precharged. Therefore, it becomes possible to increase the speed of writing data signals.

In one vertical-scan period or one frame period, there is a period of time, after writing of a data signal is started, where the luminance corresponds to the data signal. This time-period is determined to be an effective period. The length of effective period is determined according to the type of a driven element such as the organic EL element 21 by controlling the timing of transmitting a reset signal. For example, in the case of the organic EL element, it becomes possible to compensate for the characteristic of the organic EL element, adjust the color balance, and so forth, by changing the length of the effective period even though the characteristic of the organic EL element may vary according to the color of light emitted therefrom, such as R (red), G (green), and B (blue).

In general, where the entire one vertical-scan period or the entire one frame period is used, problems such as blur of the outline of animation for display or the like may arise. However, the visibility of the animation for display can be increased by adjusting the length of the effective period as required by controlling the transmission of reset signals.

As a modification of the first exemplary embodiment, it may be arranged that the value of operating voltage Vdx, is set so as to be substantially equivalent to that of the driving voltage Vdd, and the data-current, Idata, flows in a predetermined direction so that it flows from the operating voltage Vdx to the single-line driving circuit 30. The basic configuration of the pixel circuit 20 is the same as in the case of the first exemplary embodiment. However, the type of conduction of the compensation transistor Q13 and the driving transistor Q10 must be N. Further, it is preferable that the reset voltage Vr is set at a low level so as to correspond to the N-type transistors.

Further, the pixel electrode and a counter electrode, that are connected to the driving transistor Q10, function as a cathode electrode and an anode electrode, respectively, and the driving voltage Vdd is set to a low level (Vss), thereby a current flows from the counter electrode to the power line L1 via the organic EL element 21.

Second Exemplary Embodiment

A second exemplary embodiment of the present invention will now be described with reference to FIG. 5.

In this exemplary embodiment, the data line to transmit a data signal is also used as a signal line to transmit a reset signal. In contrast to the first exemplary embodiment, a reset-voltage generation circuit 41*b* is provided in the data-line driving circuit 12, in place of the reset-signal generation circuit 18.

Figure 5:
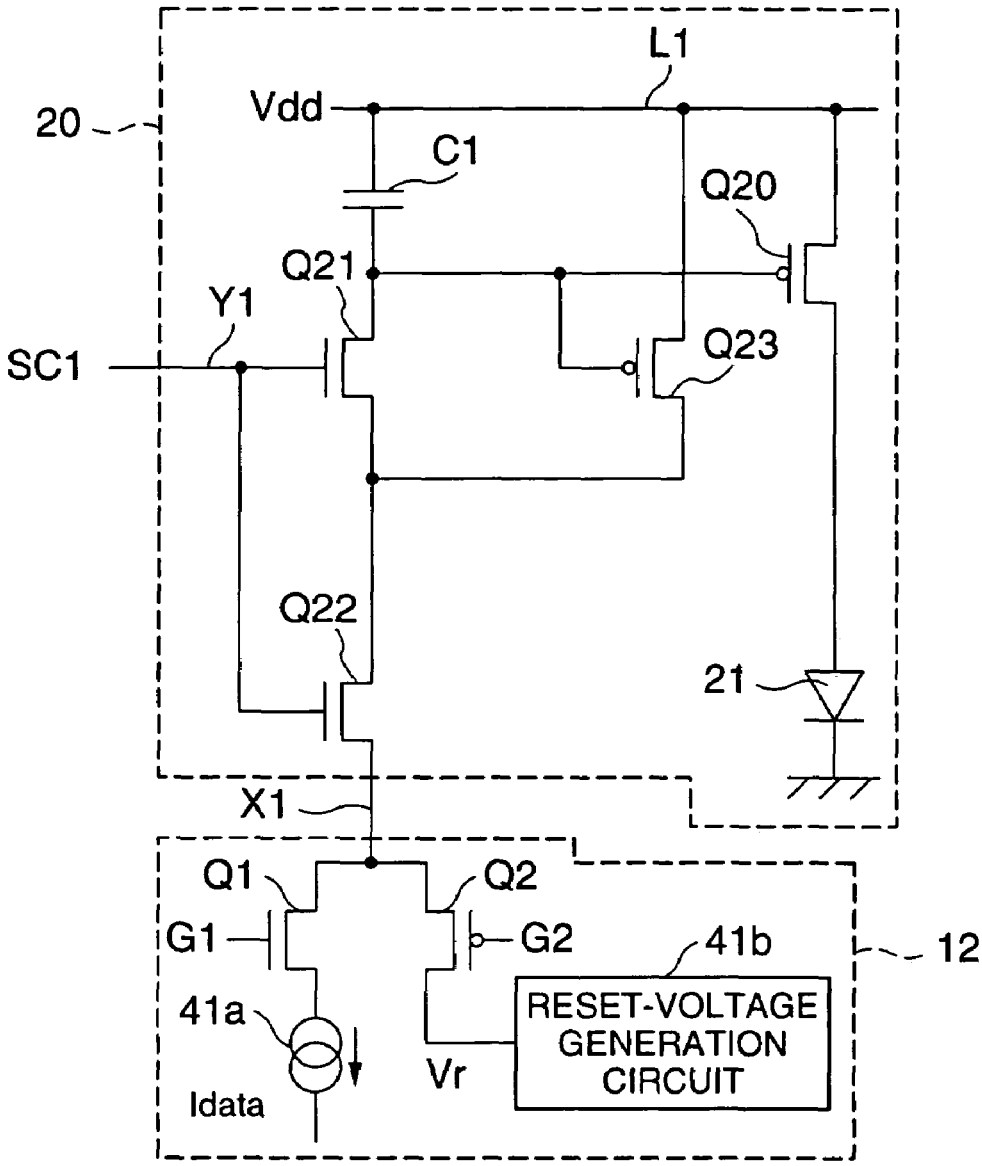
FIG. 5 is a schematic of an electronic circuit including a pixel circuit, the electronic circuit being provided in an organic EL device according to a second exemplary embodiment.

FIG. 5 illustrates the pixel circuit 20 provided at the intersection of the first data line X1 and the first scan line Y1. In this exemplary embodiment, each of the scan lines Y1 to Yn includes one scan line corresponding to the second scan line Vb, in contrast to the scan lines Y1 to Yn of the first exemplary embodiment.

The pixel circuit 20 includes a driving transistor Q20 as a first transistor, first and second switching transistors Q21 and Q22, a holding capacitor C1 as a holding element, and a compensation transistor Q23.

Each of the driving transistor Q20 and the compensation transistor Q23 are formed as a P-channel transistor. Each of the first and second switching transistors Q21 and Q22, functioning as a second transistor, are formed as an N-channel transistor.

The drain of the driving transistor Q20 is connected to the organic EL element 21 via the pixel electrode, and the source thereof is connected to the power line L1. A driving voltage Vdd is transmitted to the power line L1 to drive the organic EL element 21. The holding capacitor C1 is connected between the gate of the driving transistor Q20 and the power line L1.

The gate of the driving transistor Q23 is connected to the first switching transistor Q21 and the holding capacitor C1. The first switching transistor Q21 is connected to the data line X1 via the second switching transistor Q22. The drain of the second switching transistor Q22 is connected to the drain of the driving transistor Q23.

The source of the second switching transistor Q22, is connected to the single-line driving circuit 30 of the data-line driving circuit 12, via the data line X1. More specifically, the data line X1 is connected to a voltage-generation circuit 41*a*, functioning as a current-signal output circuit in the single-line driving circuit 30, via the first switch Q1. The data line X1 is further connected to a reset-voltage generation circuit 41*b*, functioning as a voltage-signal output circuit in the single-line driving circuit 30, via the second switch Q2. The voltage-generation circuit 41*a* outputs a data-current Idata as a first signal. The reset-voltage generation circuit 41*b* generates a reset voltage Vr as a second signal. The value of the reset voltage Vr should be equivalent to a value obtained by subtracting Vth (the threshold voltage of the driving transistor Q20) from Vdd (the driving voltage) or more, to turn the driving transistor Q20 off. However, the value of reset voltage Vr should be equivalent to the value of driving voltage Vdd or more, to turn the driving transistor Q20 off more reliably.

Subsequently, when the first and second switching transistors Q21 and Q22 are turned on and the first switch Q1 is turned on, the data-current, Idata, is transmitted to the pixel circuit 20 via the data line X1. Further, when the first and second switching transistors Q21 and Q22 are turned on and the second switch Q2 is turned on, the reset voltage Vr is transmitted to the pixel circuit 20 via the data line X1.

The scan line Y1 is connected to the gates of the first and second switching transistors Q21 and Q22, so that the first scan-signal SC1, for controlling, is transmitted from the scan line Y1.

The action of the organic EL device 10 configured as described above will now be described by illustrating the operation of the pixel circuit 20.

Figure 6:
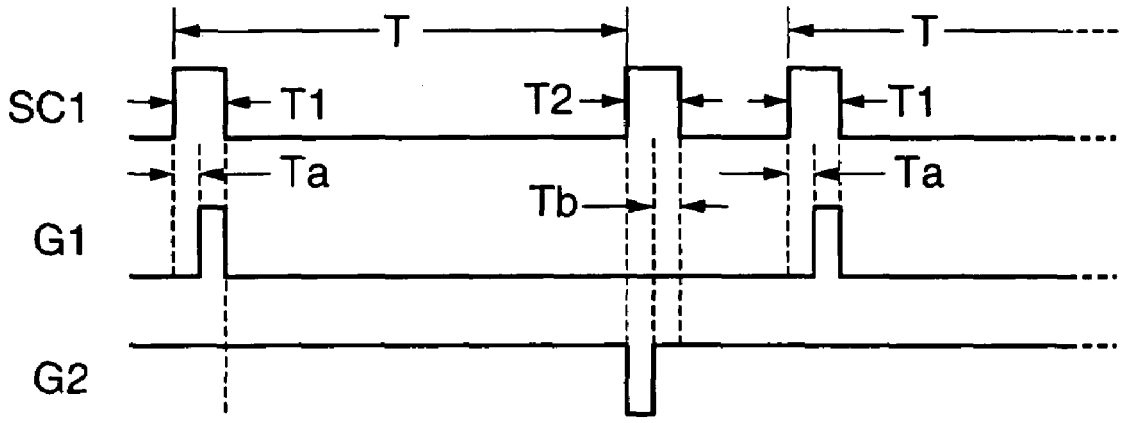
FIG. 6 shows time charts illustrating the operation of the electronic circuit according to the second exemplary embodiment.

FIG. 6 shows timing charts illustrating the operation of the pixel circuit 20. FIG. 6 illustrates the pixel circuit 20 provided for a single scan line. The second scan-signal SC1 is transmitted from the scan-line driving circuit 13 to the gates of the first and second switching transistors Q21 and Q22 via the scan line Y1. The first gate-signal G1 is transmitted to the gate of a transistor forming the first switch Q1. The second gate-signal G2 is transmitted to the gate of a transistor forming the second switch Q2.

The data-current, Idata, is transmitted to the pixel circuit 20 by turning the first switch Q1 on, turning the second switch Q2 off, and turning the first and second switching transistors Q21 and Q22 on. More specifically, an electrical-charge amount corresponding to the data-current, Idata, is accumulated in the holding capacitor C1 via the first switching transistor Q21 at the instant when the data-current, Idata, passes through the compensation transistor Q23 and the second switching transistor Q22. Subsequently, the conduction between the compensation transistor Q23 and the driving transistor Q20, forming a current mirror with the compensation transistor Q23, is determined. A current with a predetermined current level corresponding to the conduction state of the driving transistor Q20 is transmitted to the organic EL element 21.

Then, the first and second switching transistors Q21 and Q22 are turned on, the first switch Q1 is turned off, and the second switch Q2 is turned on a second time, respectively, whereby the reset voltage Vr is transmitted to the pixel circuit 20, an electrical-charge amount corresponding to the reset voltage is accumulated in the holding capacitor C1, and the driving transistor Q20 is substantially turned off. In this state, the pixel circuit 20 waits for the next writing of a data-current Idata.

Further, in this exemplary embodiment, the data-currents, Idata, and the reset voltages Vr are transmitted via the data lines X1 to Xm. Therefore, the timing of transmitting the reset voltage Vr should be set so as not overlap the timing of transmitting the data-current, Idata, to the pixel circuit 20 connected to a scan line different from the scan line Y1 connected to the above-described pixel circuit 20.

Therefore, in this exemplary embodiment, transmission of the data-current, Idata, to the corresponding pixel circuit 20 is delayed by a time period Ta with reference to a time period Ta where the first and second switching transistors Q21 and Q22 are turned on. Further, the transmission of data-current, Idata, is finished at the end of the time period T1.

Transmission of the reset voltage Vr is started at the instant when a time period T2 where the first and second switching transistors Q21 and Q22 are turned on is started. Further, the transmission of the reset voltage Vr is finished at a time period Tb ahead of the end of the time period T2.

For example, the period where the first and second switching transistors Q21 and Q22 are turned on, are divided into a plurality of sub-time periods, and two of them are used as a sub-time period where a data signal is transmitted and a sub-time period where a reset signal is transmitted, respectively.

In this exemplary embodiment, the period where the first and second switching transistors Q21 and Q22 are turned, on is divided in two sub-time periods. The reset voltage Vr is transmitted in the first sub-time period and the data-current, Idata, is transmitted in the second sub-time period. Conversely, the data-current, Idata, may be transmitted in the first sub-time period and the reset voltage Vr may be transmitted in the second sub-time period.

The length of each of the plurality of sub-time periods may be set appropriately. However, the length of time required to write a data signal, often varies according to the signal level. Therefore, the length of sub-time periods may preferably be determined so as to correspond to the level of a signal that requires time longer than time other signals require to be written.

When the data signal is transmitted as a current signal as in this exemplary embodiment, the length of time required to write the data signal becomes longer than in the case where a voltage signal is written. Therefore, the length of a sub-time period to write the data signal is preferably set so as to be longer than time required to write a reset signal transmitted as the voltage signal.

Effects of this exemplary embodiment are similar to those of the first exemplary embodiment. However, since the reset voltages Vr are transmitted via the data lines X1 to Xm, other effects are produced as below.

The data lines X1 to Xm are substantially precharged by reset voltages Vr. In general, parasitic capacitance of the data line is larger than that of the pixel circuit, even though there may be differences in detail according to the number of pixel circuits or the panel size. Therefore, the data lines X1 to Xm are precharged before data writing is performed so that the following data writing can be performed at high speed.

Further, unlike the first exemplary embodiment, no wiring is provided specifically designed to transmit the reset signals. Therefore, if the configuration of the pixel circuit is the same as in the case of the first exemplary embodiment, it becomes possible to decrease the number of wiring provided for one pixel circuit. Subsequently, the aperture ratio of the pixel circuit can increase.

Further, according to the second exemplary embodiment, the current-generation circuits 41*a* and the reset-voltage-signal generation circuits 41*b* are included in the data-line driving circuits and connected to one ends of the data lines X1 to Xm. However, the current-generation circuits 41*a* and the reset-voltage-signal generation circuits 41*b* may be provided separately. For example, the data-line driving circuit 12, including the current-generation circuits 41*a* and the reset-voltage signal generation circuits 41*b*, may be connected to one and the other ends of the data lines X1 to Xm, respectively.

Figure 7:
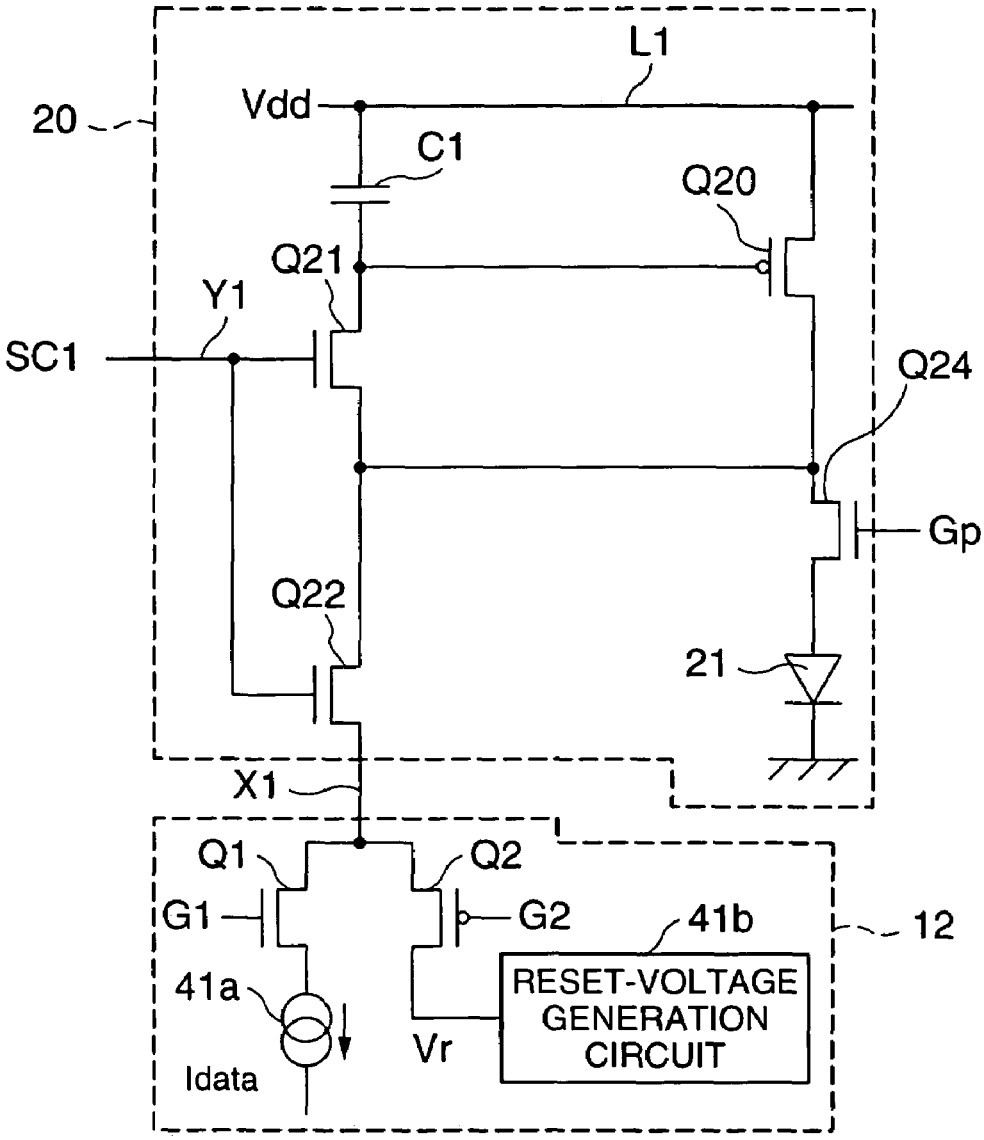
FIG. 7 shows a schematic of the electronic circuit according to the second exemplary embodiment.

FIG. 7 shows an example modification of the second exemplary embodiment. The pixel circuit 20 includes the driving transistor Q20 functioning as the first transistor, the first and second switching transistors Q21 and Q22, the holding capacitor C1 functioning as a holding element, and a light-emission control transistor Q24 controlled by a control signal Gp.

The basic operation of the electronic circuit shown in FIG. 7 is the same as in the case of the circuit shown in FIG. 5 and the timing charts shown in FIG. 6. However, this electronic circuit is different from the above-described circuit in that the data-current, Idata, is transmitted to the pixel circuit 20 when the light-emission control transistor Q24, which is controlled by the control signal Gp, is turned off and the driving transistor Q20 and the organic EL element 21 are not electrically connected.

At the time of light-emission, the light-emission control transistor Q24 is turned on, whereby a current whose level corresponds to the conduction state of the driving transistor Q20 is transmitted to the organic EL element 21.

In this pixel circuit, the light-emission control transistor Q24 can be turned off as required within a time period other than the time period where the data-current, Idata, is transmitted to the pixel circuit 20. Therefore, a light-emission time period can be controlled by using the light-emission control transistor Q24.

However, according to the configuration shown in FIG. 7, the reset voltage Vr is transmitted via the data line X1. Therefore, it becomes possible to precharge the holding capacitor C1 and the data line X1 at the instant when the reset operation is performed. Subsequently, there is no need to independently set a time period where the reset operation is performed and a time period where the precharge is performed, whereby one frame can be effectively used.

Figure 8:
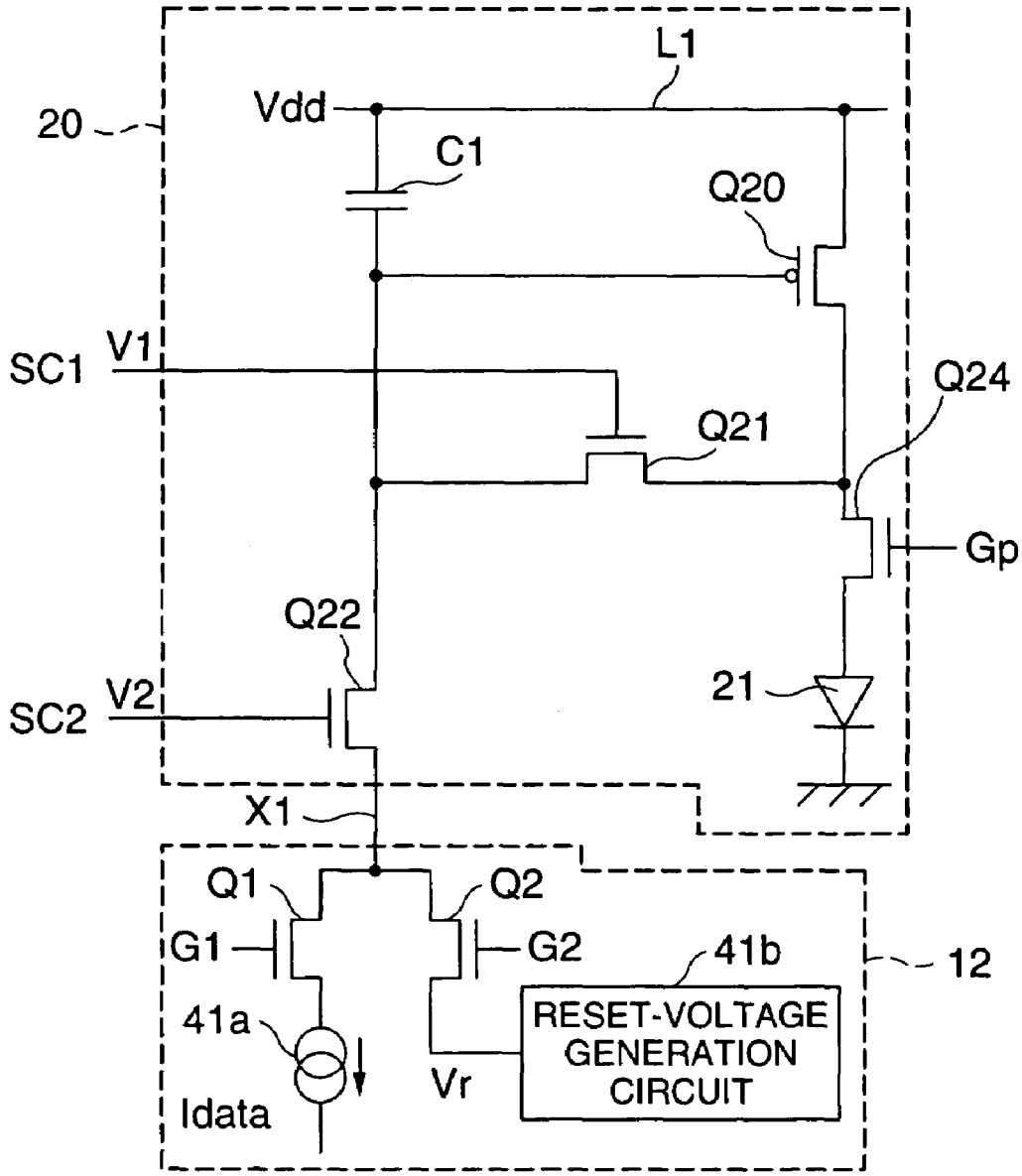
FIG. 8 shows another schematic of the electronic circuit according to the second exemplary embodiment.

FIG. 8 shows a connection point of the first switching transistor Q21, the connection point being different from that of the pixel circuit shown in FIG. 7. In the pixel circuit shown in FIG. 7, the first switching transistor Q21 also controls the electrical connection between the drain of the driving transistor Q20 and the gate thereof, which is the same as in the case of the pixel circuit shown in FIG. 8. However, in the pixel circuit shown in FIG. 8, the first switching transistor Q21 is provided between the drain of the driving transistor Q20 and the drain of the second switching transistor Q22, and the data-current, Idata, passes the driving transistor Q20, the first switching transistor Q21, and the second switching transistor Q22.

For transmitting the data-current, Idata, the first switching transistor Q21 and the second switching transistor Q22 need to be turned on. However, to transmit the reset voltage Vr, only the second switching transistor Q22 needs to be turned on. Therefore, the operation timing of the electronic circuit shown in FIG. 8 is basically the same as that shown by the timing charts in FIG. 4, except that the first scan-signal SC1 and the second scan-signal SC2 are interchanged.

However, according to the configuration shown in FIG. 8, the reset voltage Vr is transmitted to the pixel circuit 20, in addition to the data-current, Idata, via the data line X1. Therefore, to reduce crosstalk, the time period T1 where the first switching transistor Q21 and the second switching transistor Q22 are turned on for transmitting the data-current, Idata, and the time period T2 where the second switching transistor Q22 is turned on to transmit the reset voltage Vr are divided into a plurality of sub-time periods, respectively, as in the case of FIG. 6. One of the plurality of sub-time periods may preferably be used as a sub-time period where the data-current, Idata, is transmitted and another thereof may preferably be used as a sub-time period where the reset voltage Vr is transmitted.

The pixel circuit 20 shown in FIG. 8 includes the light-emission control transistor Q24 controlled by the control signal Gp as in the case of the pixel circuit 20 shown in FIG. 7. At least within the time period where the data-current, Idata, is transmitted to the pixel circuit 20, the light-emission control transistor Q24 is turned off and the electrical connection between the driving transistor Q24 and the organic EL element is shut off.

At the light-emission time, the light-emission control transistor Q24 is turned on, whereby a current whose level corresponds to the conduction state of the driving transistor Q20 is transmitted to the organic EL element 21.

Further, in this pixel circuit, the light-emission control transistor Q24 can be turned off as required within a time period other than the time period where the data-current, Idata, is transmitted to the pixel circuit 20. Therefore, the light-emission time period can also be controlled by using the light-emission control transistor Q24.

However, according to the configuration shown in FIG. 8, the holding capacitor C1 or the data line X1 can be precharged at the instant when the reset operation is performed by transmitting the reset voltage Vr via the data line X1. In this case, it is not necessary to independently set a time period to reset and a time period to precharge. Consequently, one frame can be effectively used.

Figure 9:
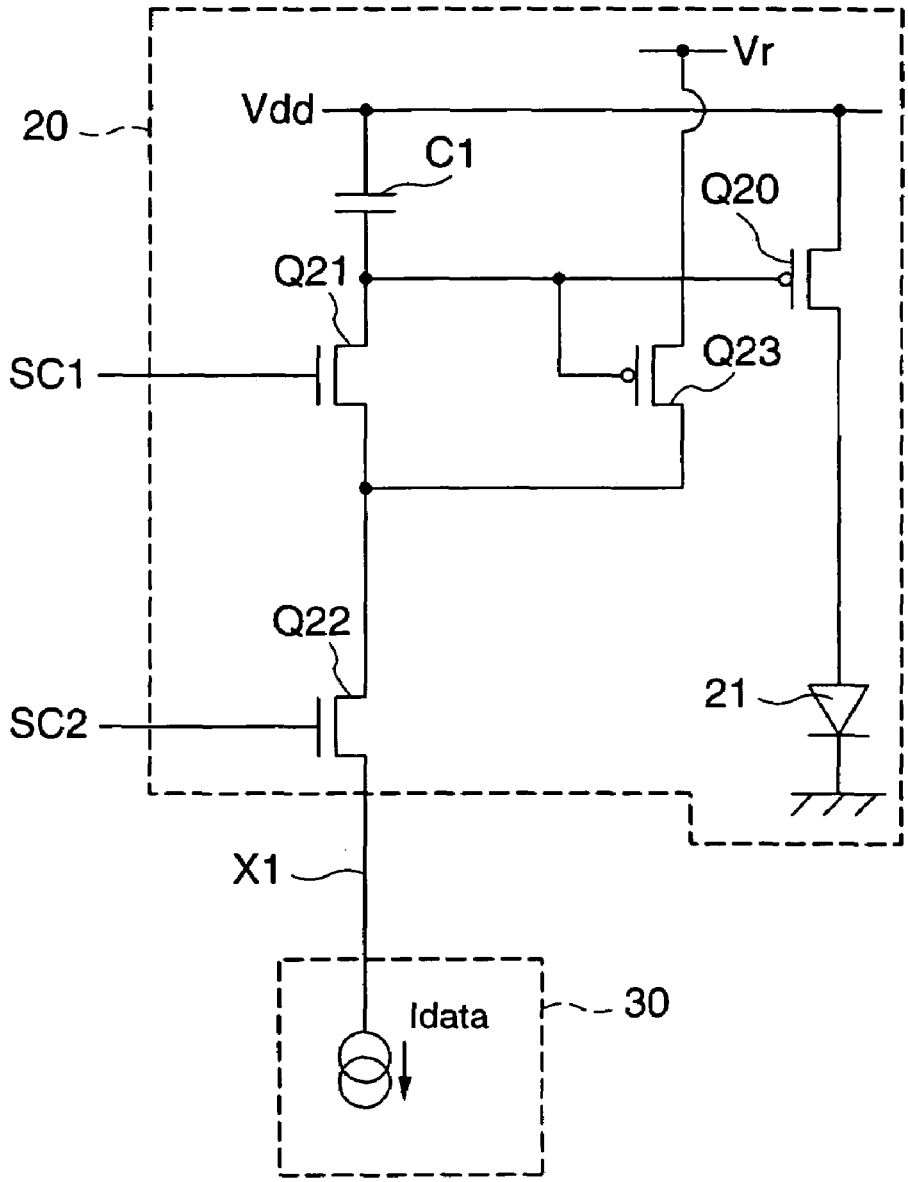
FIG. 9 is a circuit schematic illustrating the electronic circuit according to an exemplary embodiment.

FIG. 9 shows an example modification of the pixel circuit 20 shown in FIG. 5. In the pixel circuit 20 shown in FIG. 9, a reset operation is performed by transmitting the reset voltage Vr via the source of the compensation transistor Q23.

The first and second switching transistors Q21 and Q22 are independently turned on and off by the first scan-signal SC1 and the second scan-signal SC2, respectively.

The first and second scan-signals SC1 and SC2 to turn the first and second switching transistors Q21 and Q22 on, respectively, are output simultaneously for a predetermined time period, whereby the first and second switching transistors Q21 and Q22 are turned on. Subsequently, an electrical-charge amount corresponding to the data-current, Idata, is accumulated in the holding capacitor C1.

The driving transistor Q20 transmits a driving current corresponding to the accumulated electrical-charge amount to the organic EL element 21 and makes the organic EL element 21 emit light. At this time, the first switching transistor Q21 and the second switching transistor Q22 are turned off.

After a predetermined light-emission time period has elapsed, the first scan-signal SC1 to turn the first switching transistor Q21 on is output for a predetermined time period while the second switching transistor Q22 is kept turned off, whereby the first switching transistor Q21 is turned on. Subsequently, the reset voltage Vr is transmitted to the holding capacitor C1 via the source of the compensation transistor Q23. In this case, the value of voltage transmitted to the holding capacitor C1 is equivalent to Vr-Vth (Vth is the threshold voltage of the compensation transistor Q23).

It becomes possible to perform the reset operation only by turning the first switching transistor Q21 on, as described above, by adjusting the characteristic of the driving transistor Q20 or the compensation transistor Q23 so that the driving transistor Q20 is substantially turned off when a voltage equivalent to Vr−Vth or more is transmitted to the gate of the driving transistor Q20.

The source of the compensation transistor Q23 may be connected to the driving voltage Vdd in such a manner that the source of the driving transistor Q20 is connected thereto so that the driving voltage Vdd can be used as the reset voltage Vr. Subsequently, the number of wiring used for one pixel circuit can be reduced.

In the case of the pixel circuit 20 shown in FIG. 7 and that shown in FIG. 8, the reset operation can be performed in the above-described manner, even though a reset-signal generation circuit or a reset-voltage generation circuit specifically designed for the reset operation is not provided.

More specifically, the drain and gate of the driving transistor Q20 are electrically connected when the first switching transistor Q21 is turned on while the second switching transistor Q22 is kept being turned off, whereby the potential of the gate becomes equivalent to Vdd−Vth (Vth=the threshold voltage of the driving transistor Q20) and the driving transistor Q20 is substantially turned off.

Figure 10:
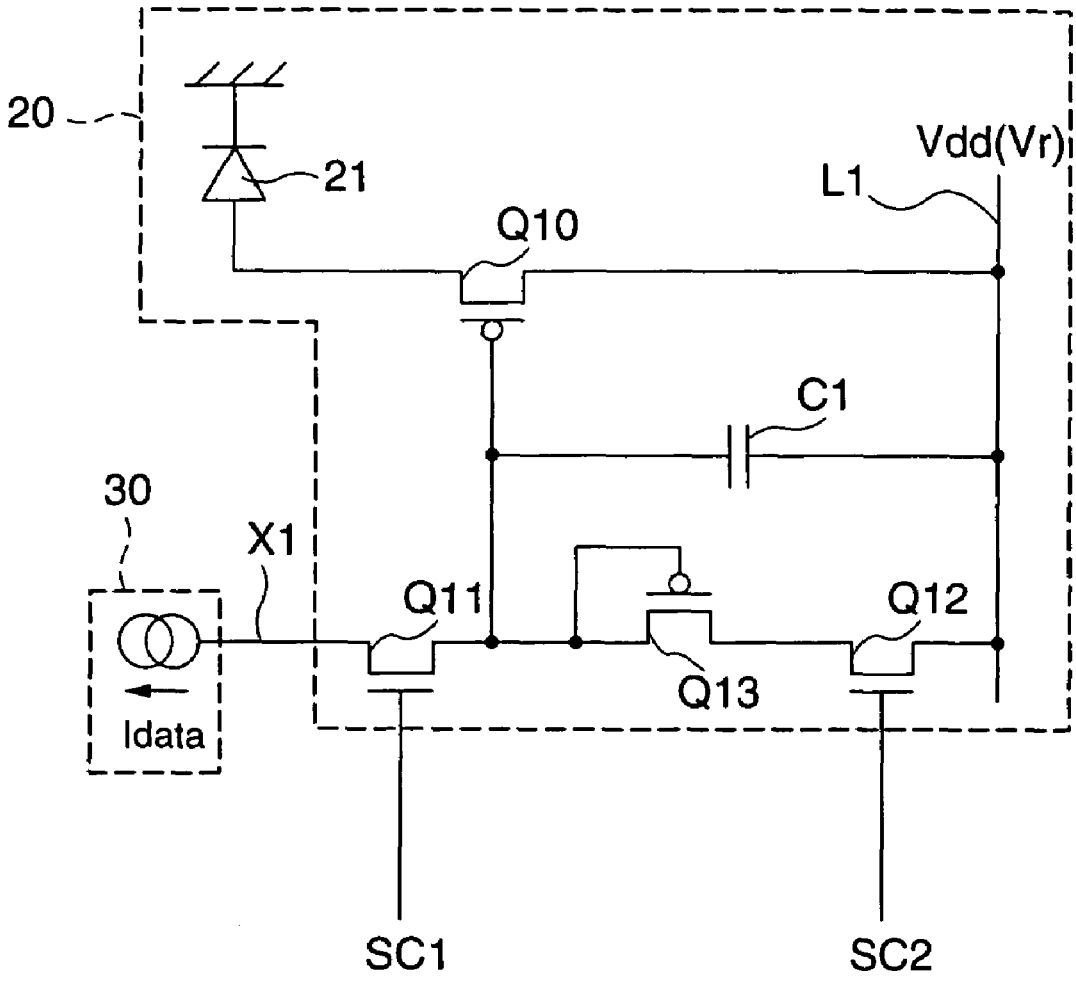
FIG. 10 is a circuit schematic illustrating the electronic circuit according to an exemplary embodiment.

FIG. 10 shows an example modification of the pixel circuit 20 shown in FIG. 3. In the case of this pixel circuit 20 shown in FIG. 10, the data-current, Idata, is transmitted from the single-line driving circuit 30 to the data line X1, as in the case of the pixel circuit shown in FIG. 3. However, unlike the case of FIG. 3, the driving voltage Vdd is used as the reset voltage Vr in place of the voltage-signal transmission lines Z1 to Zp.

The first scan-signal SC1 and the second scan-signal to turn the first and second switching transistors Q11 and Q12 on, respectively, are transmitted, whereby both the first and second switching transistors Q11 and Q12 are turned on. Subsequently, the data-current, Idata, passes the first and second switching transistors Q11 and Q12 and the compensation transistor Q13 and an electrical-charge amount corresponding to the data-current, Idata, is accumulated in the holding capacitor C1.

The reset operation is performed by turning the first switching transistor Q11 off and turning the second switching transistor Q12 on, and transmitting the driving voltage Vdd to the holding capacitor C1 via the first switching transistor Q12 and the compensation transistor Q13.

The timing of transmitting the first and second scan-signals SC1 and SC2 relating to the operation of the circuit shown in FIG. 10 is the same as the timing chart of the first and second scan-signals SC1 and SC2 among the timing chart shown in FIG. 4, the timing charts illustrating.

Figure 11:
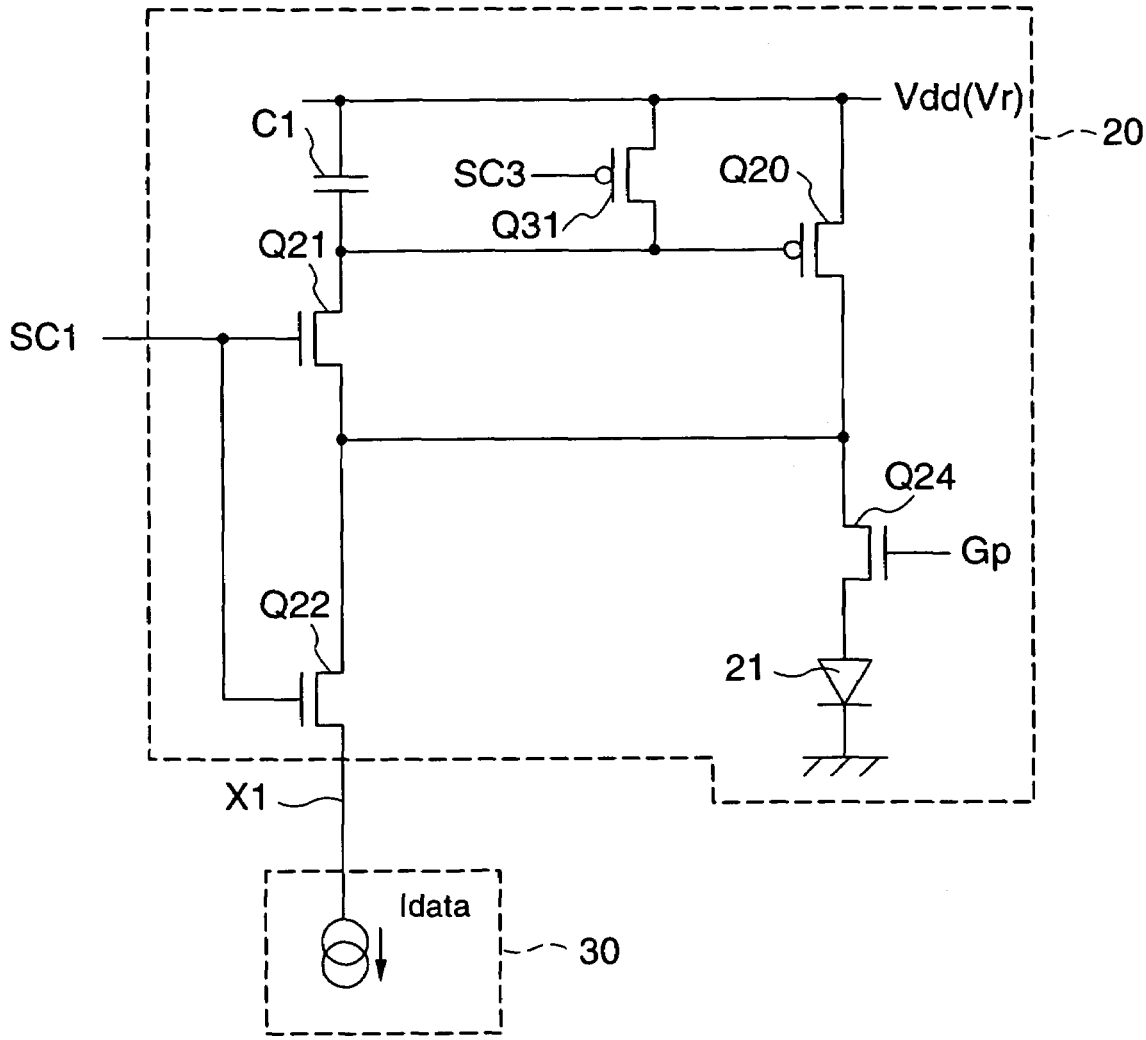
FIG. 11 is a circuit schematic illustrating the electronic circuit according to an exemplary embodiment.

FIG. 11 shows an example modification of the circuit shown in FIG. 7. In this electronic circuit shown in FIG. 11, the driving voltage Vdd is used as the reset voltage Vr. The pixel circuit 20 shown in FIG. 11 includes a reset transistor Q31 to control the electrical connection between the gate of the driving transistor Q20 and the driving voltage Vdd. The first and second switching transistors Q21 and Q22 are turned off and the reset transistor Q31 is turned on, whereby the value of gate voltage of the driving transistor Q20 becomes almost equivalent to that of the driving voltage Vdd and the driving transistor Q20 is reset.

Figure 12:
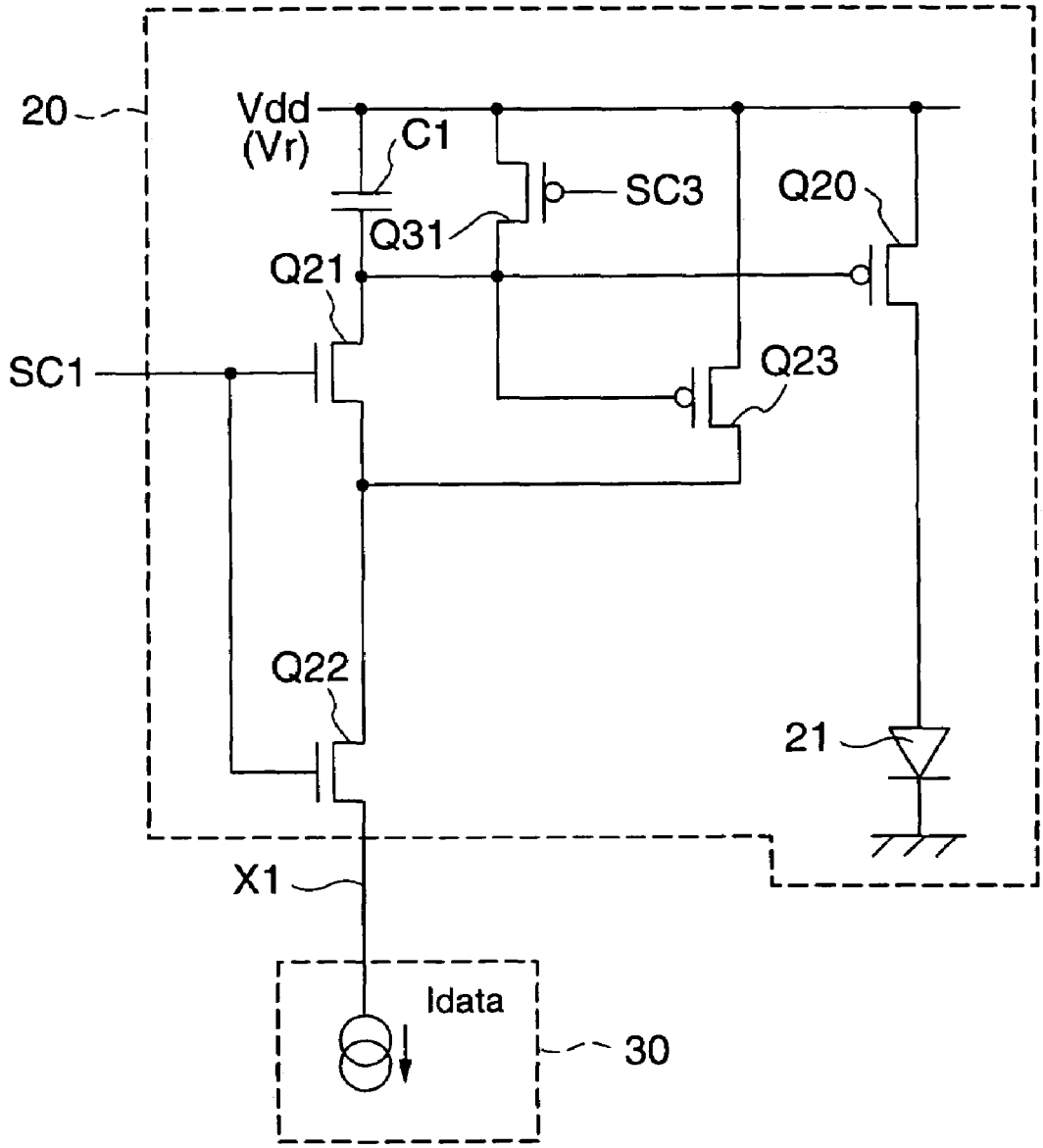
FIG. 12 is a circuit schematic illustrating another modification of the electronic circuit according to an exemplary embodiment.

FIG. 12 shows an example modification of the pixel circuit 20 shown in FIG. 5. According to the configuration shown in FIG. 12, the reset-voltage generation circuit 41*b* shown in FIG. 5 is omitted. However, the driving voltage Vdd is used as the reset voltage Vr. Further, the reset transistor Q31 controls the electrical connection between the gate of the driving transistor Q20 and the driving voltage Vdd. By turning the reset transistor Q31 on, the value of gate voltage of the driving transistor Q20 becomes substantially equivalent to the value of driving voltage Vdd, whereby the driving transistor Q20 is reset.

Figure 13:
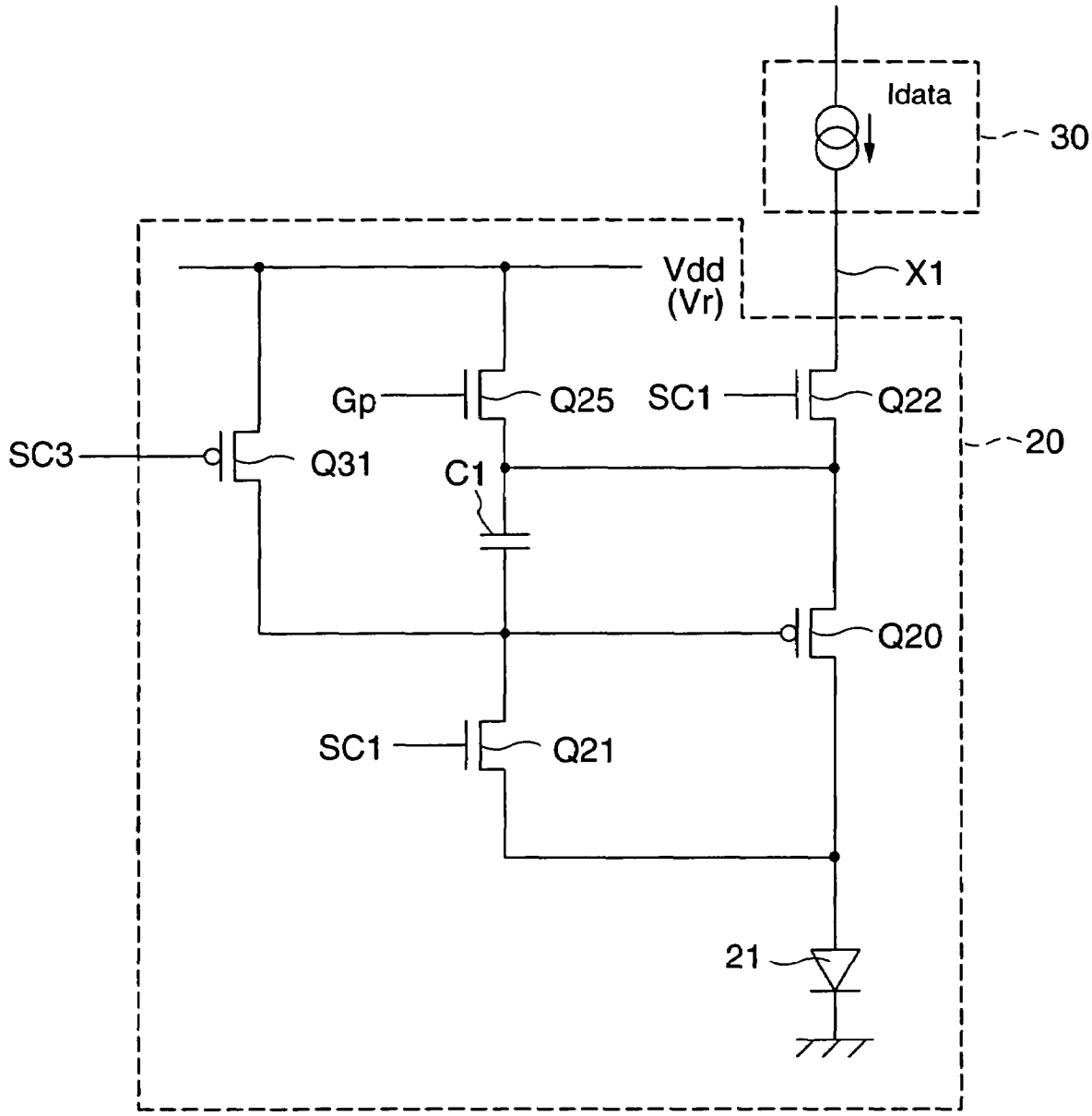
FIG. 13 is a circuit schematic illustrating another modification of the electronic circuit according to an exemplary embodiment.

FIG. 13 shows other configuration. A pixel circuit 20 shown in FIG. 13 includes the driving transistor Q20 connected to the organic EL element 21, the first switching transistor Q21 to control the electrical connection between the drain and gate of the driving transistors 20, the second switching transistor Q22 to control the connection between the data line X1 and the pixel circuit 20, a light-emission control transistor Q25 that controls the conduction between the driving voltage Vdd and the driving transistor Q20 and that is controlled by the control signal Gp, and the reset transistor Q31 to control the connection between the holding capacitor C1 and the driving voltage Vdd, functioning as the reset voltage Vr.

The light-emission control transistor Q25 and the reset transistor Q31 are turned off and the first and second switching transistors Q21 and Q22 are turned on, whereby the data-current, Idata, passes the second switching transistor Q22 and the driving transistor Q20 and an electrical-charge amount corresponding to the data-current, Idata, are accumulated in the holding capacitor C1.

Then, the first and second transistors Q21 and Q22 are turned off while the reset transistor Q31 is kept being turned off. Instead of the first and second transistors Q21 and Q22, the light-emission control transistor Q25 is turned on, whereby a current with a current level corresponding to the data-current, Idata, passes the driving transistor Q20 whose conduction state is determined according to the electrical-charge amount that corresponds to the data-current, Idata, and that is held in the holding capacitor C1. Then, the current is transmitted to the organic EL element 21, and the organic EL element 21 emits light.

Next, the reset transistor Q32 is turned on, whereby an electrical-charge amount corresponding to the reset voltage Vr (Vdd) is accumulated in the holding capacitor C1 and the driving transistor Q20 is substantially turned off.

Each of the pixel circuits shown in FIG. 8 and that shown in FIG. 11 include the light-emission control transistor Q24 between the driving transistor Q20 and the organic EL element 21. The pixel circuit 20 shown in FIG. 13 includes the light-emission control transistor Q25 having a function similar to that of the above-described light-emission control transistor Q24. Therefore, in some cases, only to control light emission, the pixel circuit 20 may not require the reset transistor Q31. However, the use of the reset transistor Q25 is effective. For example, since the pixel circuit 20 is precharged by the reset voltage Vr (Vdd), the next data-current, Idata, can be written at high speed.

The organic EL device functioning as an electronic device that has been illustrated in the above-described embodiments may be used for an electronic apparatus such as a mobile personal computer, a mobile phone, a digital camera, and so forth.

Figure 14:
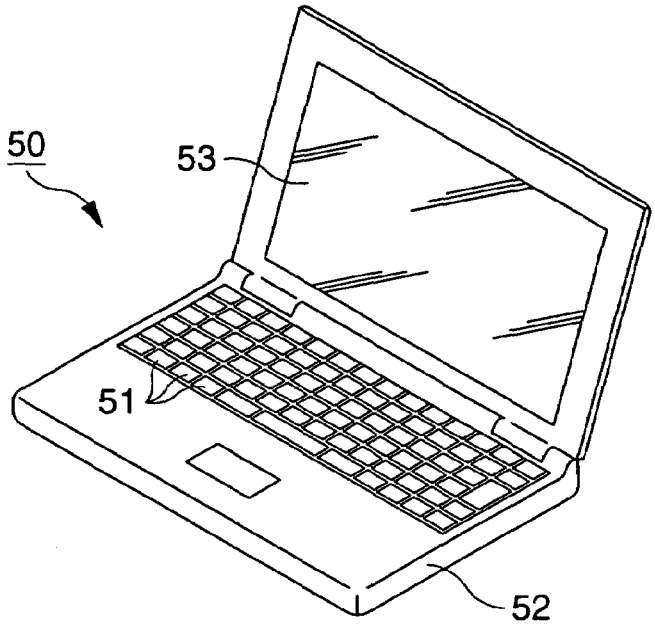
FIG. 14 is a perspective view illustrating the configuration of a mobile personal computer using an optoelectronic device.

FIG. 14 is a perspective view illustrating the configuration of a mobile personal computer. In this drawing, a personal computer 50 includes a main-body unit 52 having a keyboard 51 and a display unit 53 using the organic EL device.

Figure 15:
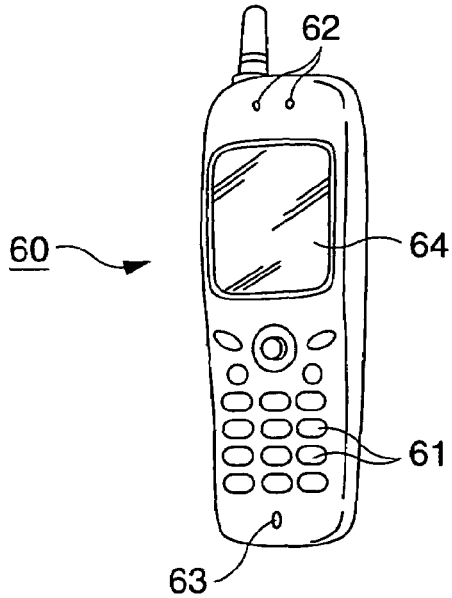
FIG. 15 is a perspective view of a mobile phone using the optoelectronic device.

FIG. 15 is a perspective view illustrating the configuration of a mobile phone. In this drawing, a mobile phone 60 includes a plurality of operation buttons 61, an ear piece 62, a mouthpiece 63, and a display unit 64 using the organic EL device.

In the above-described embodiments, P-type transistors are used as the driving transistors Q10 and Q20. However, N-type transistors can also be used.

N-type transistors are used as the first switching transistors Q11 and Q21 and the second switching transistors Q12 and Q22, but it is not limited thereto and the P-type transistors can also be used.

Further, the reset transistor Q31 may be formed as an N-type transistor even though it is formed as a P-type transistor according to the above-described embodiments. However, the decision about which type to select should be made according to the value of reset voltage Vr. For example, when the level of the reset voltage Vr is high, the P-type transistor is preferably used as in the above-described embodiments. If the driving transistors Q10 and Q20 are formed as N-type transistors and a voltage at a low level is used as the reset voltage Vr, the reset transistor Q31 is preferably formed as an N-type transistor. Subsequently, it becomes possible to narrow the range of the driving voltages or the level of signals transmitted to the pixel circuit 20, whereby the power consumption or the load on the circuit can be reduced.

Although the above-described embodiments refer to the pixel circuit 20 to drive the organic EL element, the present invention can be applied to other types of optoelectronic elements, such as a liquid-crystal element, an electron-emission element, an element, and so forth, so as to form an optoelectronic device.

The invention claimed is:

1. A method to drive an electro-optical device including, a plurality of scan lines, a plurality of data lines, a plurality of pixel circuits having a switching transistor, a holding element, a driving transistor, and an electro-optical element, the plurality of pixel circuits being provided at the intersections of the plurality of scan lines and the plurality of data lines, the method comprising:

first transmitting a scan-signal to turn the switching transistor on to each of the plurality of pixel circuits via one of the plurality of scan lines—the one corresponding to the pixel circuit—and transmitting a data signal to the holding element via one of the plurality of data lines—the one corresponding to the pixel circuit, and the switching transistor—accumulating an electrical amount corresponding to the data signal in the holding element, and setting the driving transistor to a first conduction state according to the electrical amount corresponding to the data signal, the electrical amount being accumulated in the holding element; and second transmitting a driving voltage or a driving current with a voltage level or a current level corresponding to the first conduction state to the electro-optical element, a plurality of times, and after the first and second transmittings are performed, setting the driving transistor to a second conduction state being performed before the first transmitting is performed next time.

2. A method to drive an electro-optical device including, a plurality of scan lines, a plurality of data lines, a plurality of pixel circuits having a switching transistor, a holding element, a driving transistor, and an electro-optical element, the plurality of pixel circuits being provided at the intersections of the plurality of scan lines and the plurality of data lines, the method comprising:

first transmitting a scan-signal to turn the switching transistor on to each of the plurality of pixel circuits via one of the plurality of scan lines—the one corresponding to the pixel circuit—and transmitting a data signal to the holding element via one of the plurality of data lines—the one corresponding to the pixel circuit—and the switching transistor, accumulating an electrical amount corresponding to the data signal in the holding element, and setting the driving transistor to a first conduction state according to the electrical amount corresponding to the data signal, the electrical amount being accumulated in the holding element; and second transmitting a driving voltage or a driving current with a voltage level or a current level corresponding to the first conduction state to the electro-optical element, a plurality of times, and after the first and second transmittings are performed, setting the driving transistor to a second conduction state by transmitting a voltage signal to the holding element is performed before the first transmitting is performed next time.

3. A method to drive an electro-optical device including, a plurality of scan lines, a plurality of data lines, a plurality of pixel circuits having a switching transistor, a holding element, a driving transistor, and an electro-optical element, the plurality of pixel circuits being provided at the intersections of the plurality of scan lines and the plurality of data lines, the method comprising:

first transmitting a scan-signal to turn the switching transistor on to each of the plurality of pixel circuits via one of the plurality of scan lines—the one corresponding to the pixel circuit—and transmitting a current signal as a data signal to the holding element via one of the plurality of data lines—the one corresponding to the pixel circuit—and the switching transistor, accumulating an electrical amount corresponding to the data signal in the holding element, and setting the driving transistor to a first conduction state according to the electrical amount corresponding to the data signal, the electrical amount being accumulated in the holding element; and second transmitting a driving voltage or a driving current with a voltage level or a current level corresponding to the first conduction state to the electro-optical element, a plurality of times, and after the first and second transmittings are performed, setting the driving transistor to a second conduction state being performed before the first transmitting a scan-signal is performed next time.

4. The method to drive an electro-optical device according to claim 2, when setting the driving transistor, the voltage signal being transmitted to the holding element via the driving transistor, whereby the driving transistor is set to the second conduction state.

5. The method to drive an electro-optical device according to claim 2, each of the plurality of pixel circuits includes a compensation transistor in addition to the driving transistor, the compensation transistor having a gate connected to the holding element, and when setting the driving transistor, the voltage signal being transmitted to the holding element via the compensation transistor, whereby the driving transistor is set to the second conduction state.

6. The method to drive an electro-optical device according to claim 2, each of the plurality of pixel circuits includes a reset transistor having a source and a drain, one of the source and the drain being connected to a gate of the driving transistor and the other being connected to a supply source of the voltage signal, a current signal is transmitted as the data signal to the holding element in the first transmitting, and the voltage signal is transmitted to the holding element via the reset transistor when setting the driving transistor, whereby the driving transistor is set to the second conduction state.

7. The method to drive an electro-optical device according to claim 2, when setting the driving transistor, the voltage signal being transmitted via the corresponding data line and the switching transistor, whereby the driving transistor is set to the second conduction state.

8. The method to drive an electro-optical device according to claim 1, the second conduction state being set so as to be lower than the first conduction state.

9. The method to drive an electro-optical device according to claim 1, the second conduction state being substantially equivalent to a state where the driving transistor is turned off.

10. A method to drive an electro-optical device, including a plurality of scan lines, a plurality of data lines, a plurality of pixel circuits having a switching transistor, a holding element, a driving transistor, and an electro-optical element, the plurality of pixel circuits being provided at the intersections of the plurality of scan lines and the plurality of data lines, the method comprising:

first transmitting a scan-signal to turn the switching transistor on to each of the plurality of pixel circuits via one of the plurality of scan lines—the one corresponding to the pixel circuit—and transmitting a data signal to the holding element via one of the plurality of data lines—the one corresponding to the pixel circuit—and the switching transistor, accumulating an electrical amount corresponding to the data signal in the holding element, and setting the driving transistor to a first conduction state according to the electrical amount corresponding to the data signal, the electrical amount being accumulated in the holding element; and second transmitting a driving voltage or a driving current with a voltage level or a current level corresponding to the first conduction state to the electro-optical element, is repeated a plurality of times, and after the first and second transmittings are performed, stopping transmission of the driving voltage or the driving current to the electro-optical element being performed before the first transmitting is performed next time.

11. The method to drive an electro-optical device according to claim 10, each of the plurality of pixel circuits including a period-control transistor between the driving transistor and the electro-optical element, and in the second transmitting, the period-control transistor being turned on and when stopping transmission of the driving voltage, the period-control transistor is turned off, whereby transmission of the driving voltage or the driving current to the electro-optical element is stopped.

12. The method to drive an electro-optical device according to claim 10, in the first transmitting, a current signal being transmitted as the data signal.

13. The electro-optical device driven according to a method to drive an electro-optical device according to claim 1.

14. An electro-optical device, comprising:

a plurality of data lines;

a plurality of scan lines;

a plurality of pixel circuits that are provided at the intersections of the plurality of scan lines and the plurality of data lines and that has an electro-optical element;

a current-signal output circuit that is connected to the plurality of data lines and that outputs a data-current as a data signal to the plurality of pixel circuits via the plurality of data lines;

a reset-signal generation circuit that is connected to the plurality of data lines and that outputs a reset-electrical signal to the plurality of data lines for setting the luminance of the electro-optical element to zero; and a switch to control electrical connection among the current-signal output circuit, the reset-signal generation circuit, and the plurality of data lines.

15. An electro-optical device, comprising:

a plurality of data lines;

a plurality of scan lines;

a plurality of pixel circuits that are provided at the intersections of the plurality of scan lines and the plurality of data lines and that has an electro-optical element;

a current-signal output circuit that is connected to the plurality of data lines and that outputs a data-current as a data signal to the plurality of pixel circuits via the plurality of data lines;

a plurality of voltage-signal transmission lines to transmit a reset-electrical signal to set the luminance of the electro-optical element to zero; and a reset-signal generation circuit that is connected to the plurality of voltage-signal transmission lines and that outputs the reset-electrical signal.

16. The electro-optical device according to claim 15, the plurality of voltage-signal transmission lines extending in a direction along which the plurality of scan lines extend.

17. The electronic apparatus having an electro-optical device according to claim 13, the electro-optical device being mounted thereon.

18. An electro-optical device, comprising:

a plurality of data lines;

a plurality of scan lines; and a plurality of electronic circuits, each of the plurality of electronic circuits including:

a first transistor;

a second transistor that is controlled by a scan signal supplied through one scan line of the plurality of scan lines and that controls an electrical connection between one of a source and a drain of the first transistor and one data line of the plurality of data lines; and a holding element that is connected to a gate of the first transistor, the holding element accumulating a first electrical charge whose amount corresponds to a current level of a data current that flows through the first transistor during at least a part of a first period in which one of the source and the drain of the first transistor is electrically connected to the one data line, and the holding element accumulating a second electrical charge whose amount corresponds to a voltage level of a voltage signal that is supplied to the holding element during a second period.

19. The electro-optical device according to claim 18, the voltage signal being supplied to the holding element through the second transistor during the second period.

20. The electro-optical device according to claim 18, the voltage signal being set so that a conduction state of the first transistor determined based on the second electrical charge is lower than a conduction state of the first transistor determined based on the first electrical charge.

21. The electro-optical device according to claim 18, each of the plurality of electronic circuits further including an electro-optical element, a driving current whose level corresponds to the amount of the first electrical charge being supplied to the electro-optical element during a predetermined period.

22. The electro-optical device according to claim 18, each of the plurality of electronic circuits further including an electro-optical element, a driving current whose level corresponds to the amount of the first electrical charge being supplied to the electro-optical element during a third period between the first period and the second period.

* * * * *